US010987266B2

(12) United States Patent
Domenick

(10) Patent No.: US 10,987,266 B2
(45) Date of Patent: Apr. 27, 2021

(54) ROTATIONAL/TRANSLATIONAL TRANSFER LIFT

(71) Applicant: Robert Domenick, Los Angeles, CA (US)

(72) Inventor: Robert Domenick, Los Angeles, CA (US)

( * ) Notice: Subject to any disclaimer, the term of this patent is extended or adjusted under 35 U.S.C. 154(b) by 0 days.

(21) Appl. No.: 14/958,945

(22) Filed: Dec. 4, 2015

(65) Prior Publication Data

US 2017/0156959 A1 Jun. 8, 2017

(51) Int. Cl.
*A61G 7/10* (2006.01)
*A61G 5/14* (2006.01)

(52) U.S. Cl.
CPC ..... *A61G 7/1017* (2013.01); *A61G 5/14* (2013.01); *A61G 7/1015* (2013.01); *A61G 7/1038* (2013.01); *A61G 7/1051* (2013.01); *A61G 7/1076* (2013.01); *A61G 7/1096* (2013.01)

(58) Field of Classification Search
CPC ..... A61G 7/00; A61G 7/10; A61G 7/1017; A61G 7/1096
USPC ..... 5/81.1 R, 81.1 RP, 83.1
See application file for complete search history.

(56) References Cited

U.S. PATENT DOCUMENTS

| | | | | |
|---|---|---|---|---|
| 4,569,094 A * | 2/1986 | Hart | A61G 7/1017 280/250.1 |
| 5,524,303 A * | 6/1996 | Palmer, Jr. | A61G 7/1015 5/507.1 |
| 2005/0283906 A1* | 12/2005 | Summers | A61G 7/1051 5/86.1 |
| 2015/0190293 A1 | 7/2015 | Hacikadiroglu | |

OTHER PUBLICATIONS

"Port-A-Lift Personal Transfer System," http://www.myportalift.com/ Mar. 16, 2016.
"Golvo 8008: The Complete Mobile Lift," http://barrierfreeaccess.com/safe-patient-handling/mobile-lifts/golvo-8008.php Mar. 16, 2016.
"System RoMedic," http://www.amilakesouthern.co.uk/productcats/moving-and-handling/ Mar. 16, 2016.
"GLS5 Active Lifter," http://www.guldmann.com/Default.aspx?ID=4567&ProductID=PROD635 Mar. 16, 2016.
"EasyPivot EP-325 Patient Lift," https://www.southwestmedical.com/Patient-Lifts/EasyPivot/EasyPivot-EP-325-Patient-Lift/16265p Mar. 16, 2016.

* cited by examiner

*Primary Examiner* — Frederick C Conley
(74) *Attorney, Agent, or Firm* — Matthew J. Spark; Stefan J. Kirchanski; Zuber Lawler LLP

(57) ABSTRACT

A device positioned near a user provides support to the user in sitting and standing positions. The user can move from sitting to standing, without assistance, even if the user is relatively weakened. The device includes (1) a base and tower, and provides support to the user when in-between; (2) a personal support coupled to the tower, and operated by a user control, such as a wheel or a motor. The tower can include padding or knee support so the user can lean against the tower.

17 Claims, 18 Drawing Sheets

143
141
130
141
147
132

ROTATIONAL/TRANSLATIONAL TRANSFER LIFT

BACKGROUND

Field of the Disclosure

This Application relates to devices and methods relating to a self-lifting device, such as providing easy self-lifting between sitting to standing positions, between positions involving lying down to positions involving sitting or standing, or between other positions. In possible implementations, the devices and methods are well suited to users who might otherwise have difficulty moving, particularly who might otherwise have difficulty moving themselves between sitting and standing positions, or other between other positions as described herein.

Related Art

Many persons have difficulty moving, particularly those who are chronically disabled, or who are temporarily disabled while ill or in hospital. Movement disabilities or limitations can occur due, at least in part, to one or more of a large number of possible causes, such as muscle weakness, nerve damage, paralysis, stroke, arthritis, obesity, or otherwise. When a person finds it necessary to move their position (such as, to move between a bed and a sofa to a wheelchair and back, or between a wheel-chair and a shower and back, or between a standing position and another position), this difficulty can pose serious problems. For example, this can apply to moving between sitting and standing positions, or between other positions as described herein.

One possibility is to enlist the assistance of health-care personnel, such as a nurse, a home health-care aide, or other health-care personnel. This possibility can have the drawbacks of financial expense, or of involving the presence of at least one, and possibly more than one, additional persons for the (chronically or temporarily) disabled person to perform their daily activities, and to get about in the world, without extraordinary difficulties not typically encountered by others. This possibility can also have the drawbacks of involving substantial additional time to move from one position to another, or involving the risk of injury to the disabled person, such as by falling and possibly being unable to get back up, with or without calling for help, which might not be feasible. This possibility can also have the drawbacks of possible lack of privacy in personal affairs. For example, the disabled person might be unable to move from a bed to a restroom without the assistance of a nurse or home-healthcare aide, and it might even be the case that no such person is available at a required time. This possibility can also have the drawbacks of risk of falling or risk of injury to the disabled person, from any one of a number of possibilities. For example, the disabled person might slip loose from the grip of health-care personnel, with the possible effects of falling and/or injuring themselves or others (such as health-care personnel in the vicinity).

One possibility is to use equipment that provides leverage from an immobile location. This possibility can have the drawbacks of involving bulky and expensive equipment. Bulky and expensive equipment might restrict use to specialized facilities, such as hospitals. This possibility can have the drawbacks of involving substantially immobile equipment, with the effect of creating a need to place the equipment where its use is most likely. Placing equipment in a fixed position, even one where its use is most likely, might restrict its use to only a few most important locations, such as near hospital beds. Even in relatively convenient circumstances, should the person needing the equipment be weakened, this possibility can still involve the employment of another person to assist with mobility, with at least some of the drawbacks associated therewith. Similar to the possibility noted above, this possibility can have the drawbacks of risk of falling or risk of injury to the disabled (or otherwise mobility-restricted) person, and/or others in the vicinity. This possibility can also have the drawbacks of providing only limited mobility to the disabled person. For example, most known equipment only provides specialized movement forms to the disabled person. For example, most known equipment does not provide a more generalized ability to move to and from a mobile platform, such as a wheelchair.

Some Drawbacks of the Known Art

Each of these issues, either alone or in combination with others (whether mentioned herein or otherwise), at some times, or in some conditions, can cause one or more problems with respect to mobility.

BRIEF SUMMARY

This Application

This Application provides patentable subject matter that can ameliorate at least some of the problems described above, as well as others.

In possible implementations, a device can be positioned relative to a user, the device providing support to the user in sitting positions, standing positions, and other positions (such as when moving between sitting and standing).

For example, the user can employ the device to move from a sitting to a standing position, without necessarily needing assistance from another person, even if the user is relatively weakened. For example, the user can employ the device to move from a standing to a sitting position, without necessarily needing assistance from another person, even if the user is relatively weakened. For example, the device can also assist the user with movement between other positions, such as leaning, lying down, or other positions.

Devices and Methods of Use

The device can include a mounting base pate, a rotational base plate, a tower, a user harness, and a lifting/lowering element. This can provide the user with the ability to lift and lower themselves between a sitting position (such as in a wheelchair) and a standing position (such as holding onto the tower). This can also provide the user with support when positioned between the rotational base plate and the tower. The device can (optionally) also include one or more footrests and/or knee rests, with the effect of guiding the user's body in a superior position for lifting or lowering, and with the effect of easing and securing the user's body during operations of lifting or lowering. Examples include when the user is moving between a sitting position and a standing position, or between various locations.

The mounting base plate can be substantially affixed to the flooring or other support, such as with anti-tipping clamps, or other elements suitable to prevent the device from tipping over when the user steps onto the device. For example, when the user steps onto the rotational base plate, the rotational base plate and tower might tilt, with the effect that the device might tip over; the anti-tipping clamps can be disposed to prevent this occurrence. In one possible implementation, the mounting base plate can also be de-affixed from the flooring, and disposed to move about in a translational manner, such as on bearings (such as casters), or other elements suitable for movement.

The rotational base plate can be substantially affixed to the mounting base plate, and disposed for rotational movement, such as on bearings (such as casters), or other elements suitable for rotational movement. The rotational base plate can also be disposed to be stable against tipping over when the user is moving between sitting and standing positions (such as when the user steps onto the rotational base plate), in addition to the anti-tipping clamps coupled to the mounting base plate. In one example, the rotational base plate can be counter-weighted against tilting, or be sufficiently wide to mitigate tilting.

In possible embodiments, the device can include a personal support coupled to the tower, and operated by a control convenient to the user. In one example, the personal support can include a belt or suspenders coupled to the tower using a cable, chain, rope, wire, or other material. In one example, the control can include a motor disposed to lengthen or shorten the cable (or other connector), operating in response to a control by the user, and possibly having its lifting or lowering capability enhanced by mechanical elements such as hydraulics, gear ratios, and possibly other techniques. In one example, the control can be coupled to a motor switch accessible to the user, with the effect that the user need not use much personal strength to operate the control.

In possible embodiments, the device can be configured so that the control can be relatively easily reached by the user in a sitting position, with the effect of bolstering the ability of the user to reach and use the control when desiring to move between sitting and standing. In one example, the tower can include a crank or wheel that is relatively easily reached by the user in a sitting position. In one example, the tower can include padding or knee support disposed to allow the user to lean into the tower when moving between positions, such as sitting and standing positions. In one example, the device can include one or more additional body supports, such as footrests, handles, heel supports, and other elements disposed to ease and secure the user's transition between sitting and standing. In such cases, the additional body supports can include elements disposed to guide or support one or more elements of the user's body, while the user disposes themselves for lifting or lowering using the device.

In possible embodiments, the device can include wheels that can be unlocked when the user wishes to move the device from one place to another. The device can also include supports to allow the user to move the device, themselves, and any equipment (such as medical equipment), from one place to another.

In one example, the user can employ the device to move:

- from a lying or sitting position in bed (such as by lifting the user from a lying position in bed to a sitting position in bed, allowing the user to reorient themselves from that sitting position in bed to a position disposed for using the device),
- to a standing position near the bed (such as by lifting the user from a sitting position on a bed to a standing position using the device), to a standing position near a shower or bath (such as by motoring, or otherwise moving, the device from the bed to the shower or bath),
- to a sitting position in the shower or bath (such as by lowering the user from a standing position using the device, to a sitting position on a seat disposed in the shower or bath), and back (such as by reversing the steps of moving from a lying position in bed to a sitting position in the shower or bath).

In possible embodiments, the device can include a motor that can drive it from one location to another. In one example, the user could use the device both for moving between sitting and standing, and for traveling along a hallway or around a room. In one example, the user can employ the device as a mobile wheelchair, or electric go-kart, with the effect of being substantially unfettered with respect to movement about hallways and grounds, by disability, whether chronic or temporary.

As described herein, these features of the device, and methods of use, can provide one or more of:

- greater mobility and independence to users who are chronically or temporarily disabled, whether in relatively greater or lesser measure;
- reduced requirements for constant human assistance or oversight for those users;
- less expensive equipment, and less of it, to provide for user needs;
- the ability of health-care and other institutions to physically spread out their facilities, with substantially less concern that users will be unable to use those facilities.

Other and further advantages are described herein.

Possible Applicability

After reading this Application, those skilled in the art would recognize that techniques shown herein are applicable to more than just the specific embodiments shown herein, are within the scope and spirit of the invention, and would not require undue experiment or further invention.

Some particular implementations could include one or more of the following: providing for mobility of users whose incapacity, whether chronic or temporary, is due to excess pain; lack of skill (such as needing to re-learn to stand or walk); iatrogenic effects; mental instability; paralysis; side-effects of medication; side-effects of recreational drugs; or other incapacity not typically associated with physical incapacity or injury; providing for mobility of users who are undergoing physical therapy, and for whom the need for mobility, while not necessarily critical for life or health, is convenient or important to further the goals of that therapy; or other incapacity not typically associated with lack of function, or malfunction, of bodily capacity; providing for mobility of users assisting patients who are (legally, medically, or otherwise) required to be restrained, such as delusional or incoherent persons, legal or military prisoners, or other similarly-situated persons being transferred from one location to another, or being treated for illness or injury; where such cases could have the propensity for the assistant to be injured by the patient, or where such cases could involve a greater number of assistants without the use of mobility provided as described herein; providing for mobility of users assisting non-human animals, such as excessively strong animals, sick pets, veterinary patients, zoo animals, or other animals being treated for illness or injury; where such cases could have the propensity for the assistant to be injured by the animal, or where such cases could involve a greater number of assistants without the use of mobility provided as described herein; other, possibly related, issues related to user mobility or manipulation of their environment; or the involvement of assistants related to user mobility or manipulation of their environment.

Other and further techniques, also shown or suggested by this Application, are also applicable to more than just the specific embodiments described herein.

DETAILED DESCRIPTION OF AN EMBODIMENT

Terminology

Generality of the Description

Figure 1:
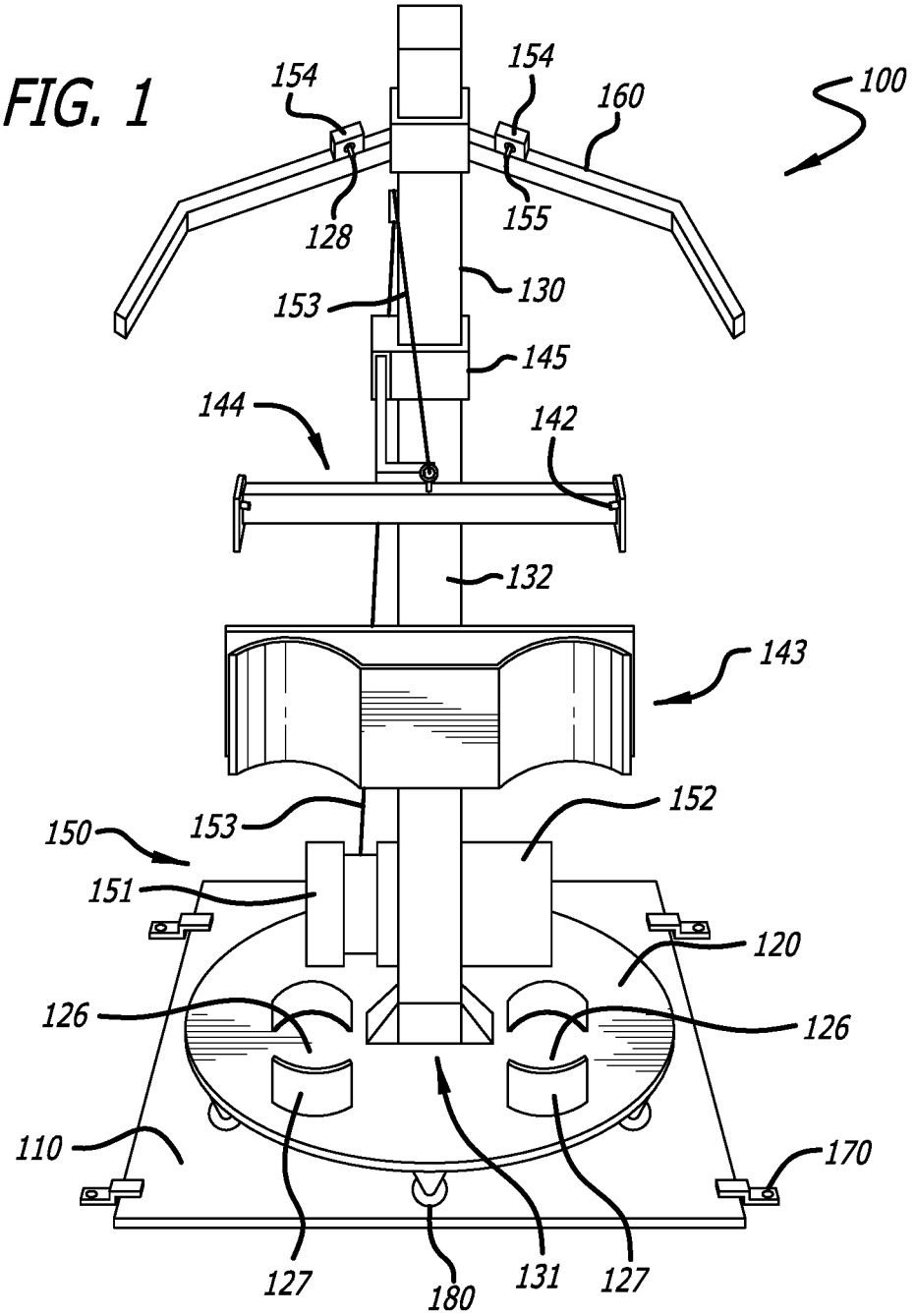
FIG. 1 shows front, downwardly angled perspective view of rotational/translational transfer lift system illustrating an embodiment of the present invention.

Ideas and technologies shown or suggested by this Application should be thought of in their most general form, including without limitation, considering one or more of the following:

The phrases and terms "Application," "this Application," "this Disclosure," and variants thereof, generally refer to this Specification, Drawings, Figures, and Claims, all other parts of this Application, and all facts known in the art at the time of filing, and all facts that can be rationally concluded therefrom.

The phrases and terms "disposed," "disposed for," "disposed to," and variants thereof, generally refer to the possibility that a particular element, collection of elements, portion of an element, or linkage between or among elements, is capable of (and optionally, well suited to) performing the described activity. For example, if an element is said to be "disposed to lift" a user, this generally refers to a capability or disposition (including positioning, orientation, or coupling) of the object.

When an apparatus element or a method step is said to "include" or "perform," and variants thereof, or otherwise be restricted in some way, this Application should be read that the subpart of the apparatus element, or the sub-step of the method, and the restriction mentioned, is only optional, not required. After reading this Application, those skilled in the art will recognize that those apparatus elements or method steps need not necessarily include or perform those particular subparts or sub-steps. In the context of the invention, no such particular subparts or sub-steps are particularly required. In an alternative embodiment, apparatus elements or method steps without those sub-parts or sub-steps would be workable, are within the scope and spirit of the invention, and would not require undue experiment or further invention.

The phrases and terms "in one example," "in one embodiment," "in one implementation," "in one scenario," "in possible examples," "in possible embodiments," "in possible implementations," "in possible scenario," and variants thereof, generally refer to the possibility that a particular characteristic, feature, or structure, described herein is included in at least one possible embodiment of the invention. Multiple uses of this phrase do not necessarily all refer to the same possible embodiment. Rather, the specific particular characteristic, feature, or structure, described herein might be combined in any suitable manner into one or more distinct possible embodiments.

The phrases and terms "perform," and variants thereof, generally refer (in the context of a program of instructions) any one or more means by which those instructions are executed or interpreted, or a device (such as a computing device) otherwise conducts the process indicated by that program of instructions. A program of instructions can be detected or interpreted at one location, and executed or its process conducted at another location. A program of instructions can be performed by a portion of a device, rather than the entire device, or by one or more devices, or by one or more portions of devices (the same device or different devices). A program of instructions can be performed by an emulated device, such as a virtual machine, "sand-box" environment, or otherwise. A program of instructions can be performed in part, halted or paused or stopped, transferred to another device, in whole or in part, and possibly continued.

In general, a description of a possible embodiment as being performed by a program of instructions generally indicates that it would not be feasible for that program of instructions to be performed by the iconic "person with pencil and paper." Although it is a mathematical axiom that a person with pencil and paper can perform any computation that could be performed by a computing device, there is no such implication that a computing device is not needed. For example, the person (such as a disabled person as described herein) can be occupied with far more important other tasks, such as maintaining their stability. For example, the person can take far more time, and be far more likely to make errors, than a computing device. For example, it can be infeasible for the person to make the computations and to provide the results of those computations to devices that need those results to operate.

The phrases and terms "relatively," and variants thereof, generally refer to any relationship in which a comparison is possible, including without limitation "relatively less," "relatively more," and otherwise. In the context of the invention, where a measure or value is indicated to have a relationship "relatively," that relationship need not be precise, need not be well-defined, and need not be by comparison with any particular or specific other measure or value. For one example, whenever a measure or value is "relatively increased" or "relatively more," that comparison need not be with respect to any known measure or value, but might be with respect to a measure or value held by that measurement or value at another place or time, or with respect to a measure or value commonly used in the art.

The phrases and terms "substantially," and variants thereof, generally refer any circumstance in which a determination, measure, value, or otherwise; is equal, equivalent, nearly equal, nearly equivalent, or approximately; what the measure or value is recited to be. For example, the phrases and terms "substantially all," and variants thereof, generally refer to any circumstance in which all, except possibly a relatively minor amount or number, have the stated property. For example, the phrases and terms "substantially none," and variants thereof, generally refer any circumstance in which none, except possibly relatively minor amount or number, have the stated property. For example, the phrases and terms "substantial effect," and variants thereof, generally refer any circumstance in which an effect might be detected or determined.

The phrases and terms "techniques," and variants thereof, generally refer to any material suitable for description, including without limitation all such material within the scope of patentable subject matter. Whenever a method step is described, those skilled in the art would know, without further invention or undue experiment, that this application thereby also describes (1) at least a first product, such as one maintaining instructions that are interpretable by a computing device, where those instructions direct one or more devices to perform that method step; and (2) at least a second product, such as one capable of performing that method step.

Specific Phrases and Terms

One or more of the following phrases and terms can be used in this Application. Where clear from the context, they can have the meanings described herein. After reading this Application, those skilled in the art would recognize that these phrases and terms can have other, broader and further, meanings as well or instead.

Ideas and technologies shown or suggested by, or specific to, this Application should be thought of in their most general form, including without limitation, considering one or more of the following:

The phrases and terms "rotational transfer lift," and variants thereof, generally refer to the systems and methods shown in this Application, or any part thereof. In the context of the invention, there is no particular requirement that the systems or methods described herein use any particular technique for lifting, lowering, or otherwise moving the user. For example, the systems or methods used with the invention, or used in conjunction with the invention, or otherwise involved with the invention, can use other techniques besides rotation. The title of this Application is not limiting in any way. For example, rotation can include any form of movement from one location to another, or one position to another, including such alternatives as translation, combinations of rotation and translation, or otherwise.

The phrases and terms "solo operation," and variants thereof, generally refer to any ability of the user to operate the system described herein and perform the method described herein, without substantial assistance by or from another person. However, these phrases and terms do not necessarily rule out the possibility that one or more other persons could provide assistance in addition to the assistance provided provided by the device. Assistance can include physical assistance, such as physically adjusting or moving the user, or mental or psychological assistance, such as providing directions or encouragement to the user. For example, one or more assistants could be involved in positioning the user within one or more portions of the system (such as the harness described herein). For example, one or more assistants could be involved in reading a set of directions to the user, or involved in reinforcing the user for successful use, or involved in training the user to operate the system described herein or perform the method described herein.

The phrases and terms "portability," "portable," and variants thereof, generally refer to any substantial ability to move the system to another location, orientation, configuration, or otherwise. For example, the system can be portable by rolling or sliding it along a floor (possibly by using a relatively frictionless surface at a bottom portion of the device, such as TEFLON), by electric or other motorized movement using treads or wheels, or otherwise. For example, one or more persons, including the user, can manually position the device, such as by pulling or pushing on the device to place it in a desired location.

The phrases and terms "disability," "disabled," and variants thereof, generally refer to any substantial degradation of the user's ability to move about. For example, disability can include substantial reduction in motility due at least in part to pain, due to muscle weakness, due to lack of muscle response (or limited muscle response), or due to a muscle response otherwise unexpected from an otherwise healthier person, or due to muscle response from a source external to the brain, due to weight, due to a need to not disturb the user's medical equipment (such as catheters, IV equipment, oxygen supplies, pain-killer supplies), or otherwise.

Any terms appearing in the figures but not explicitly described in this Application should be apparent to those skilled in the art.

System Elements

System Overview

In possible implementations, a system 100 can include elements described herein, other elements shown in the figure, and possibly other elements. Not all elements are required. Elements should be considered optional, unless otherwise specified or unless clearly obvious for operation of the system. Elements may also be embodied in one or more devices, not necessarily in only a single device.

Element Identifiers

System elements and sub-elements are sometimes described herein with respect to the following reference numbers and/or names:

100—system
101—user (not part of system)
102—origination point (not part of system)
103—destination point (not part of system)
104—bed
106—wheelchair
108—chair
110—mounting base plate

111—mounting stabilizers
112—tower mounting base
120—rotational base plate
121—rotational motor driver
122—rotational motor
123—rotational gearing
124—rotational bearings
126—user standing zone
127—user footrests
128—rotational/translational control switch
130—tower
131—tower coupling
132—tower casing
133—tower axle drive shaft
140—user harness
141—user harness compressor or spring sensors
142—user harness attachment point
143—user knee rests or knee pads
144—horizontal stabilizer assembly, including
- 144*a*—horizontal stabilizer bar or user harness bar
- 144*b*—stabilizing bar or harness bar coupling
- 144*c*—stabilizing bar holder or horizontal stabilizer element
- 144*d*—user harness or harness belt

145—horizontal mounting point
146—pin
150—lifting/lowering element assembly or control element
151—lifting motor driver
152—lifting motor or lowering motor
153—lifting cable or lowering cable
154—control element
155—lifting/lowering control switch
156—pulley
160—stabilizing handlebars
170—anti-tipping clamps
180—wheels
190—steering element These elements and sub-elements are generally referred to herein as appearing in FIGS. 1-17. The location of particular elements and sub-elements would be obvious to one of ordinary skill in the art, without undue experiment or further invention. In the context of the invention, there is no particular requirement for any particular limitation derived therefrom.

Configuration of Elements

As seen in FIGS. 1-17, in possible implementations, the system 100 could include elements shown in the figure, such as a mounting base plate 110, a rotational base plate 120, a tower 130, a user harness assembly 140, a control element or lifting/lowering element assembly 150, and possibly other elements. Although this Application focuses on implementations including all of these elements, there is no particular requirement that the invention has any such limitation. For example, there is no particular requirement for a mounting base plate 110, and the other elements described herein could have other elements substituted therefor that perform the same or similar function.

In possible implementations, a user 101 can include a person who is substantially disabled from easily moving between a sitting and standing position, or other positions. While this Application describes movement between a sitting and standing position, in the context of the invention, there is no particular requirement for any such limitation.

For example, the user 101 can transfer between other types of positions, such as kneeling, leaning against a support, lying down, or otherwise. For example, the user 101 can transfer between a hospital bed 104 and a chair 108 or wheelchair 106, between a chair 108 or wheelchair 106 and leaning against the tower 130 while moving the system 100, between leaning against the tower 130 and a position in a bath or shower, or otherwise.

In possible implementations, the user 101 can begin operation of the system 100 when positioned in a source user chair (an origination point 102, herein sometimes referred to as an "OP"), and end operation of the system 100 when positioned in a target user chair (a destination point 103, herein sometimes referred to as a "destination point 103 or position" or a "DP"). For example, the user 101 can move between the origination point 102, which could include a seat in a wheelchair 106, or another chair 108. Similarly, the destination point 103, which could include a seat in another location, such as a second chair, a bed 104, a bathtub, a couch, or any other location for which it could be convenient for the user 101 to move themselves. In traversing a reverse path, the old destination point 103 could become the new origination point 102, and the old origination point 102 could become the new destination point 103. Alternatively, the user 101 could traverse a new path, in which the old destination point 103 could become the new origination point 102, and in which the user 101 could select a different destination point 103.

While this Application describes movement between a fixed origination point 102 and destination point 103, in the context of the invention, there is no particular requirement for any such limitation. It is possible for the user 101 to change their mind and to select a new destination point 103 while in the middle of a transfer.

For example, the user 101 can transfer between a sitting position and a position leaning against the tower 130 while moving the system 100. This could have the effect of providing the user 101 the ability to move between a chair (an origination point 102) and a bath or shower (a destination point 103), and vice versa (in which the just-described origination point 102 and destination point 103 would be reversed).

Rotational Base Plate

In possible implementations, the rotational base plate 120 can include any structure capable of supporting a relatively heavy user (up to perhaps 1,000 pounds, or more), combined with elements or techniques for moving the user 101. For example, the rotational base plate 120 can include a relatively sturdy element of any suitable material. Suitable materials can include heavy steel or other type of metallic plate, heavy plastic or other plastic capable of supporting the weight of the user 101, or any one or more other materials capable of performing the functions described herein, such as carbon fiber, or otherwise). When the material is relatively weak, the rotational base plate 120 can be thicker, or when the material is relatively strong, the rotational base plate 120 can be thinner.

The rotational base plate 120 can be shaped like a circle (or optionally a hexagon, a square, or other shape), and with a diameter sufficient to support the user 101. In one case, the diameter could be approximately thirty inches, or otherwise smaller than typical openings in an area in which the user 101 desires to move about, or otherwise larger to allow the user 101 a greater rotational arc of movement. For example, in buildings in which doors can be approximately thirty-two inches wide, the rotational base plate 120 can have a diameter of approximately thirty inches, with the effect that the device can be disposed to enter and exit doors.

Although this Application focuses on implementations in which the radius of arc is relatively large enough to make a substantial transfer, or in which the diameter of the rotational base plate 120 is relatively small enough to fit though doorways or other openings, in the context of the invention, there is no particular requirement for any such limitation.

In possible implementations, the rotational base plate 120 can include a system mover, disposed to transfer the user 101 between positions.

For example, the rotational base plate 120 can include one or more layers of support material as described above, and be coupled to a second layer of support material, such as the mounting base plate 110, with the second layer of support material being of any suitable material as described with respect to the rotational base plate 120. In one embodiment, the rotational base plate 120 and the mounting base plate 110 can be detached from the anti-tipping clamps 170 and from their location on the floor, so as to provide translational (linear) movement from an origination point 102 to a destination point 103, and possibly back. In such cases, described below with respect to a section on translational movement, the rotational base plate 120 and the mounting base plate 110 can be moved in a translational manner (see, e.g., FIGS. 12-16). In such cases, the mounting base plate 110 can include wheels with bearings (such as casters or other devices having similar functions), or other anti-friction elements, and can be coupled to a translational motor, to provide for movement in a translational manner. This can have the effect of providing the user 101 with the ability to move from an origin location to a destination point that is substantially distant, such as substantially farther than a diameter of the rotational base plate 120.

The mounting base plate 110 can include an anti-tipping element, such as one or more anti-tipping clamps 170. Alternatively, the anti-tipping element can include one or more anti-tipping bars, counterweights, or other elements disposed to restrain the mounting base plate 110 or the rotational base plate 120 from tipping in response to the user's weight. For example, when the user 101 steps onto the rotational base plate 120, it might occur that the mounting base plate 110, rotational base plate 120, or the tower 130 can be subject to torque from the user's weight being applied to one side of the tower 130. In such cases, it can be desirable to prevent the mounting base plate 110 or the rotational base plate 120 from tipping in response to the user's position on the rotational base plate 120. The anti-tipping element can be disposed to provide security against any such untoward activity.

In another embodiment, the rotational base plate 120 can provide rotational movement from an origination point 102 to a destination point 103, and possibly back. In such cases, described below with respect to a section on rotational movement, the rotational base plate 120 can be moved circumferentially in a rotational manner with respect to the mounting base plate 110. More specifically, the rotational base plate 120 can be rotated about a vertical axis that is perpendicular to the planes of each of the rotational base plate 120 and the mounting base plate 110, the latter two planes being substantially parallel.

This can have the effect that the rotational base plate 120 can rotate with respect to the mounting base plate 110, at least a fraction of a revolution, with possibly an unlimited maximum amount of revolution (such as multiple complete revolutions, if desired by the user 101). In one example, the rotational base plate 120 can rotate a quarter of a circle (90 degrees) or three-quarters of a circle (270 degrees) with respect to the mounting base plate 110. This could have the effect that the user 101 could transfer from the origination point 102 onto the rotational base plate 120, rotate the rotational base plate 120 by a selected number of degrees (or another angular measure) with respect to the mounting base plate 110, and thereafter transfer from the rotational base plate 120 to the destination point 103.

For example, the user 101 can use the rotational/translational control switch 128 (such as on the control element 154) to direct the rotational motor 122 to move the rotational base plate 120 in a rotational manner, with the effect of rotating the rotational base plate 120 by the selected number of degrees with respect to the mounting base plate 110. In such cases, the rotational/translational control switch 128 can cause the rotational motor controller to direct the rotational motor driver 121 to operate the rotational motor 122. This can have the effect that the rotational motor 122 engages the rotational bearings 124, and causes the rotational gearing 123 to move the rotational base plate 120 in a rotational manner. This can in turn have the effect that the rotational base plate 120 is moved in a rotational manner.

In particular implementations, the system 100 includes a power source for the rotational motor 122 to rotate the rotational base plate 120 (and where applicable, for a translational motor to translate the mounting base plate 110). The power source can be AC driven, battery driven, battery backed-up, or otherwise as suitable for maintaining power during operation. In particular implementations, the power source can be disposed on top of the rotational base plate 120; in alternative implementations, the power source can be disposed below and attached to the rotational base plate 120.

In implementations in which a translational motor translates the mounting base plate 110, the mounting base plate 110 can include one or more bearings, axles, gears, or other elements suitable to provide translational movement for the mounting base plate 110. Similar to the rotational motor 122, the translational motor can include a translational power source. Similarly, the translational power source can also be battery driven, battery backed-up, or otherwise as suitable for maintaining power during operation. Similarly, the power source can also be disposed on top of the mounting base plate 110 or the rotational base plate 120, or can be disposed there below and attached thereto.

In implementations in which a translational motor translates the mounting base plate 110, the translational motor can include a steering element 190, disposed so that the user 101 can determine a direction in which translational movement occurs. After reading this Application, those skilled in the art would recognize that translational movement need not occur in a uniform straight line; instead, the user 101 can direct the translational motor to move the system 100 in a line that includes curves, turns, or other changes of direction. Alternatively, the translational motor can be disposed to follow one or more directional elements set in the flooring or on walls, such as rails, lighting indicators, or other elements suitable for the translational motor to follow, whether directed by the user 101 or directed by another controller (such as a nurse, an assistant, or a self-driving vehicle controller).

After reading this Application, those skilled in the art would see that when the rotational base plate 120 rotates with respect to the mounting base plate 110, the center of the rotational base plate 120 will no longer be positioned over the center of the mounting base plate 110, with the effect that the user 101 would be able to step onto the rotational base plate 120 from the origination point 102 (such as a wheelchair), rotate the rotational base plate 120, and step off the rotational base plate 120 to the destination point 103 (such as another chair placed a small-to-moderate distance away). Although it is possible for the rotational base plate 120 and the mounting base plate 110 to share a rotational axis, in the context of the invention, there is no particular requirement for any such limitation.

Rotational Gearing

Figure 5:
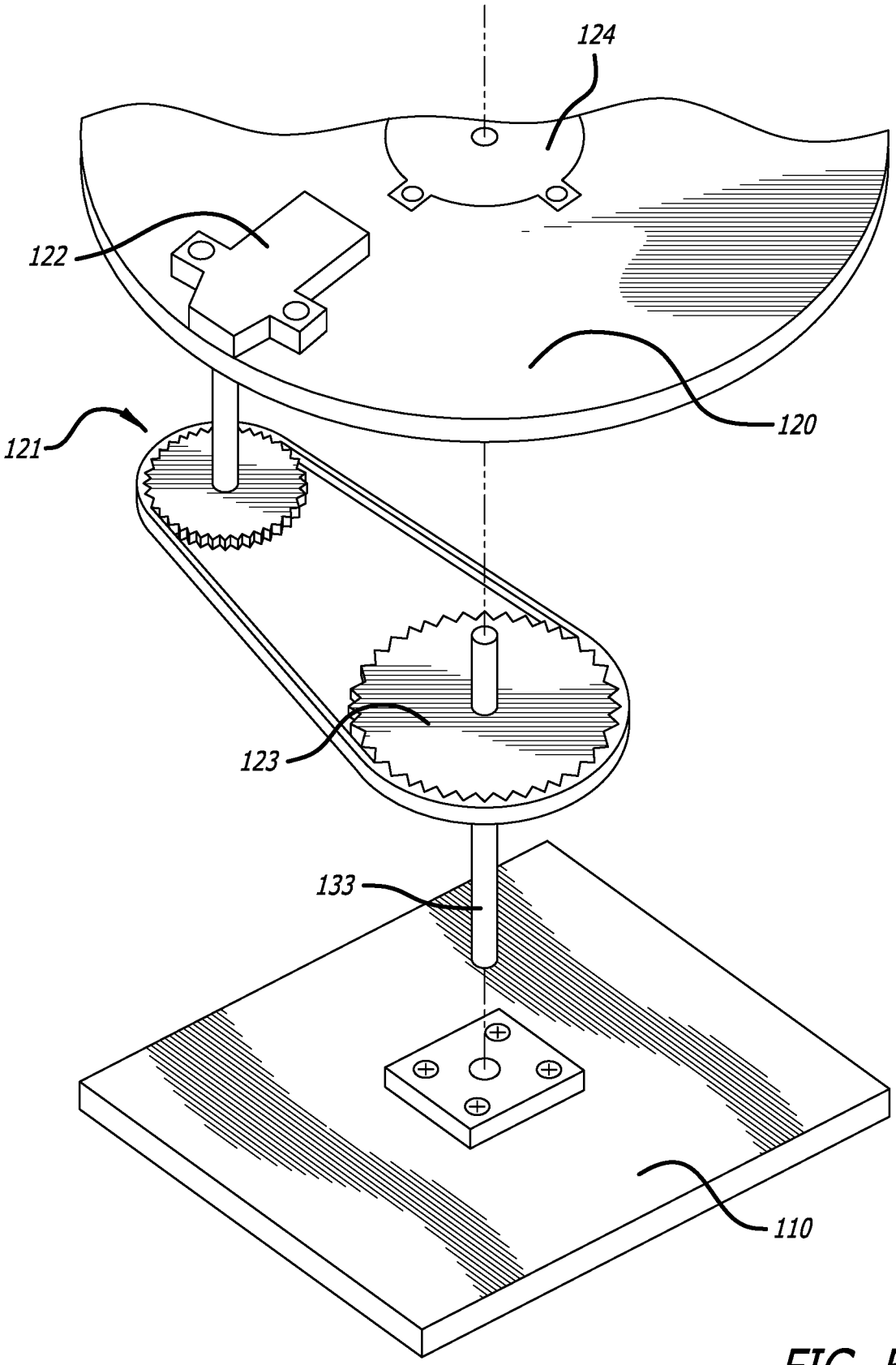
FIG. 5 is an exploded perspective view of the system of FIG. 1 showing the mounting base plate, rotational plate and mechanisms for rotating the rotational plate relative to the mounting base plate.

In possible implementations, one or more (preferably one, but it is acceptable to use more than one) rotational motors 122 can be coupled to corresponding (one or more) rotational bearings 124 (again, preferably one, but it is acceptable to use more than one) rotational motor drivers 121. The rotational motor drivers 121 can be coupled to rotational gearing 123, disposed on the drive shaft 133. The drive shaft 133 can extend into (or alternatively be attached to) the rotational bearing 124 at a top end, and extend into (or alternatively be attached to) a mounting location on the mounting base plate 110. As shown in FIG. 5, the coupling of gears allows the rotational motors 122 to be located on top of the rotational base plate 120, where there is relatively more space, and to move the drive shaft 133 underneath the rotational base plate 120, where there is relatively less space.

Translational Movement

For example, as described herein, the rotational base plate 120 can include a relatively sturdy element of any suitable material to support the user 101. As described herein, suitable materials can include one or more layers of steel plate, other metals, heavy plastic, lighter plastic in a structural form that supports weight, or other materials currently known or developed in the future.

In one embodiment, the rotational base plate 120 can be decoupled from the mounting base plate 110, and can be supported by wheels 180, coupled to the rotational base plate 120 by any form of bearings suitable to maintain the wheels 180 attached to the rotational base plate 120 while the latter engages in translational (linear) movement. Suitable bearings can include casters, or any other form of wheel attachment. Moreover, the wheels can be replaced by any other form of friction reduction element disposed to allow the rotational base plate 120 to be moved in a translational manner from one position to another. For example, the rotational base plate 120 can be coated across part or all of its bottom side with TEFLON or another anti-friction material, so that the rotational base plate 120 can be pushed or pulled in a linear direction. As described herein, the rotational base plate 120 can also be moved in a rotational manner; wheels or other anti-friction measures can be used to provide for rotational movement as well or instead.

This could have the effect that the user 101 could, once positioned on the rotational base plate 120, move the rotational base plate 120 from one location to another. This could have the effect that the user 101 could transfer from the origination point 102 to the rotational base plate 120, move the rotational base plate 120 in a translational manner to another location (such as a bath or shower) using a friction reduction element such as described herein, (optionally rotate the rotational base plate 120,) and transfer from the rotational base plate 120 to the destination point 103.

For example, the user 101 can use the rotational/translational control switch 128 (such as on the control element 154) to direct a translational motor to move the rotational base plate 120 in a translational manner, with the effect of moving the rotational base plate 120, independently of the mounting base plate 110, in a selected direction, at a selected velocity, to a selected location. In such cases, the rotational/translational control switch 128 can cause a translational motor controller to direct the translational motor to cause the rotational base plate 120 to move in a translational manner. This can in turn have the effect that the rotational base plate 120, and the user 101 standing thereon, is moved in a rotational manner.

In an alternative implementation, the rotational/translational control switch 128 can be responsive to a remote control. For example, the user 101 could use the remote control to direct the rotational/translational control switch 128 to move the rotational base plate 120 in a translational manner, to a location near the user 101. For example, the rotational base plate 120 can move, in a translational manner, (and optionally in a rotational manner,) from a location relatively distant from the user 101 (such as, distant enough that the user 101 is unable to step onto the user standing zone 126 on the rotational base plate 120) to a location relatively near the user 101 (such as, near enough that the user 101 is able to do so).

Rotational Movement

In possible implementations, the rotational base plate 120 can be coupled to a rotational motor driver 121 on either side of the rotational base plate 120, which itself could be coupled to a rotational motor 122 on the bottom side of the rotational base plate 120. The rotational motor 122 can be coupled to a set of rotational gearing 123, which itself can be mounted on a set of rotational bearings 124. This can have the effect that when the user 101 desires to rotate the system 100, the rotational motor 122 turns the rotational gearing 123, which causes the rotational base plate 120 and its associated elements to rotate about an axis through the axis of the rotational base plate 120. For example, the axis of the rotational base plate 120 can be positioned at its center, but in the context of the invention, there is no particular requirement for any such limitation; the axis of the rotational base plate 120 can be offset from the center. This can have the effect of rotating the rotational base plate 120 about that axis, thus providing rotational movement.

Rotational movement can have the effect that the user 101 can turn the rotational base plate 120, or otherwise, without the user 101 having to exert significant effort. As described herein, the user 101 could instruct the rotational base motor 122 to perform its operations using a rotational motor controller, which could also have the effect of the user 101 not having to exert significant effort.

User Positioning

In possible implementations, the rotational base plate 120 can include a user standing zone 126, disposed with sufficient space that the user 101 can stand there (albeit possibly with some assistance, such as from either a human assistant or a mechanical element). The rotational base plate 120 can also include one or more user footrests 127. The user footrests 127 could be disposed on the rotational base plate 120, positioned so that the user 101 can place their foot (or feet, if the rotational base plate 120 includes more than one user footrest 127) in the user footrests 127. For example, when the user 101 places or secures their feet in the user footrests 127, the user can achieve one or more of the following advantages:

In possible implementations, the user footrests 127 include elements coupled to the rotational base plate 120. They can be disposed so that the user 101 can place their feet in the user footrests 127. The user footrests 127 can be substantially curved, with the effect that the user's feet can rest within, and be supported at the rear by, the user footrests 127. This can provide the user 101 with both bottom and rear support for their feet while moving between a sitting and a standing position. For example, the user footrests 127 can have the approximate shape of the rear of a shoe, for each foot, with the effect that the user 101 can slip their feet into the user footrest 127 comfortably and easily.

Restraint of the user's feet is provided by the user footrests 127, with the effect that the user 101 does not fall, and does not misplace any part of their body in the rotational base plate 120;

Comfort for the user's feet provided by the user footrests 127, such as by resting against a broadly resistive support (such as possibly a foam support);

Positioning of the user's feet provided by the user footrests 127, with the effect of being able to achieve lifting of the user's body using the user harness 140, the user harness compressor 141, and the user harness connector 142 (which itself can include a belt);

Preventing damage to the user 101 provided by the user footrests 127, due to the force of lifting or lowering, such as insuring that the user 101 is well positioned with respect to a direction of force when lifting or lowering.

Figure 6:
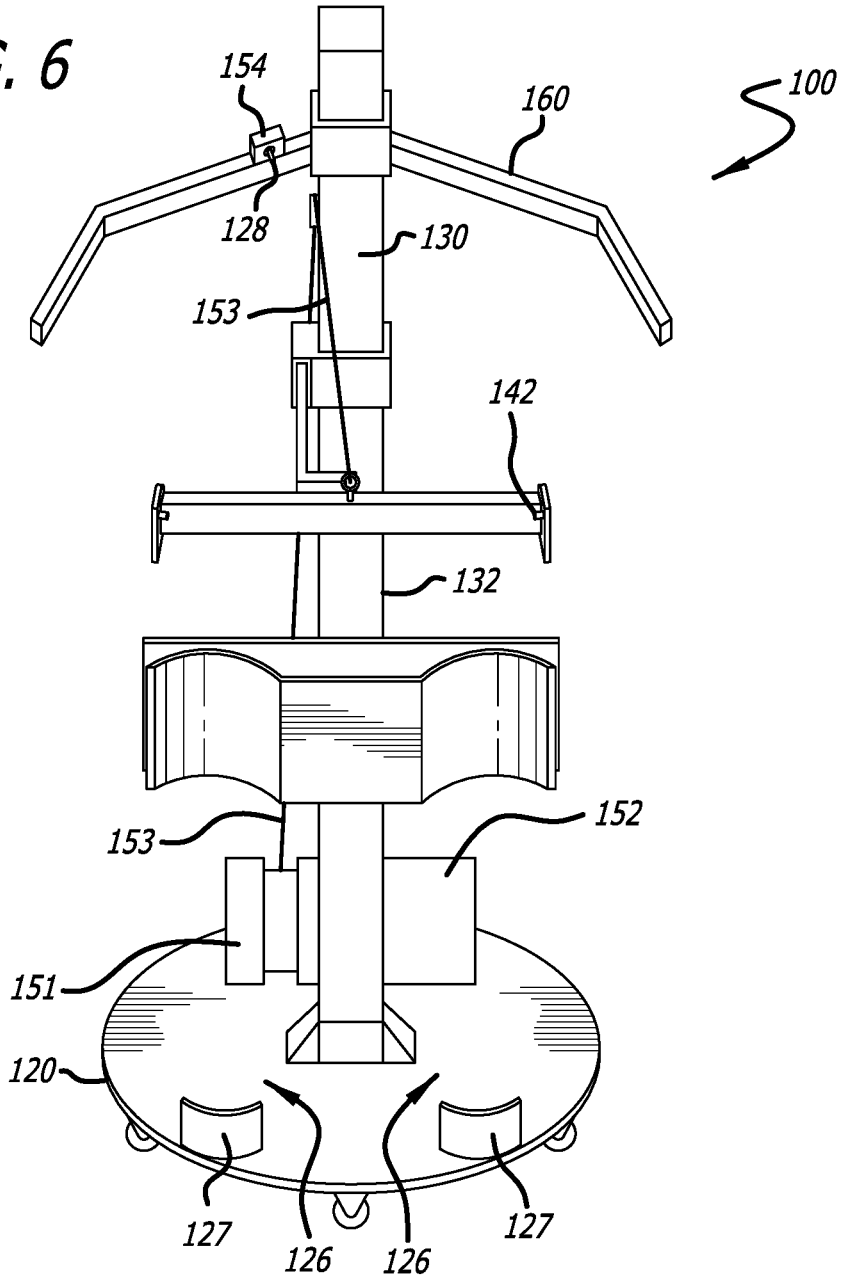
FIG. 6 is a front, downwardly angled perspective view of an alternative rotational/translational transfer lift system illustrating another embodiment of the present invention.
Figure 7:
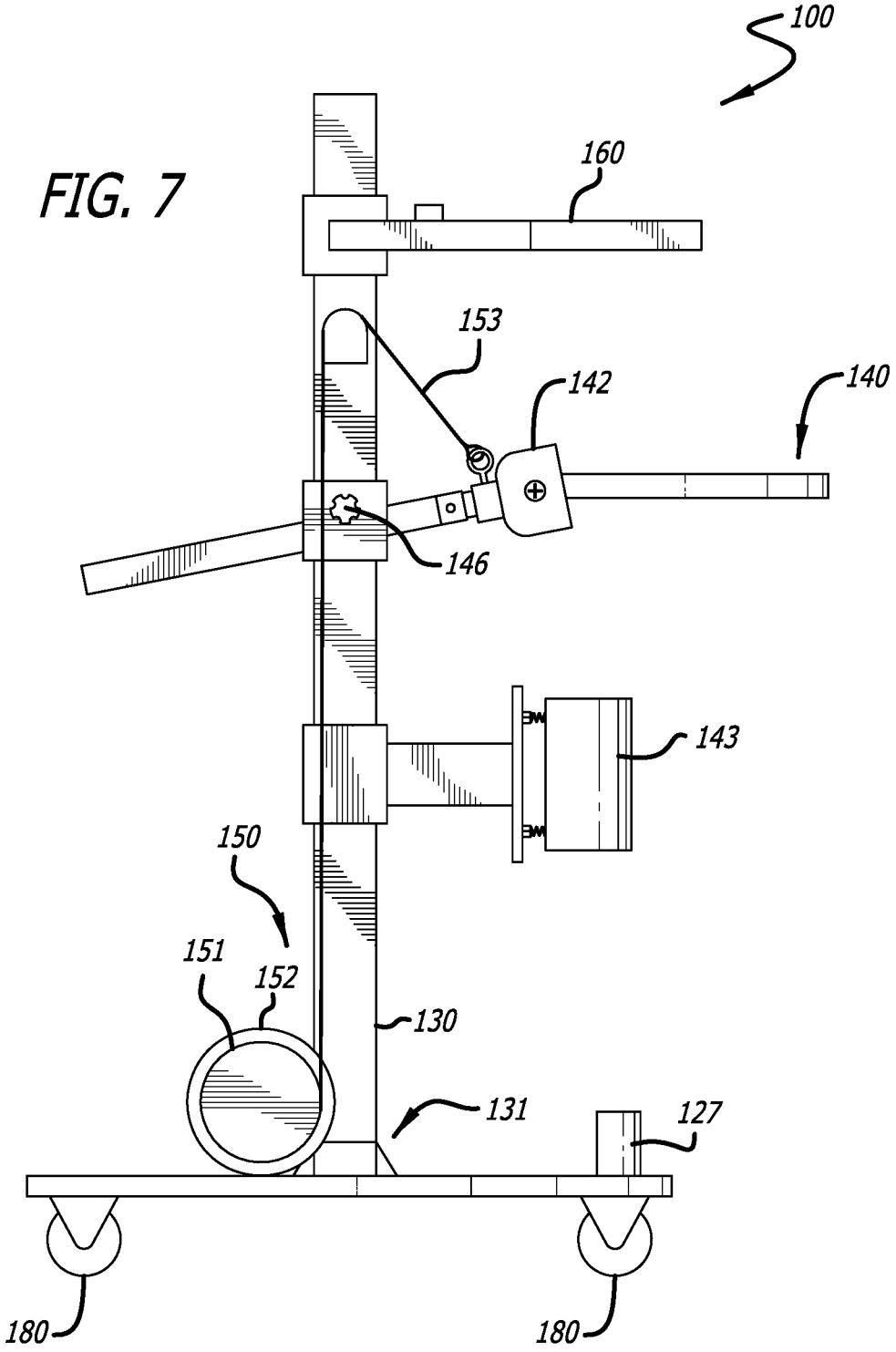
FIG. 7 is a side view of the system of FIG. 1.
Figure 8:
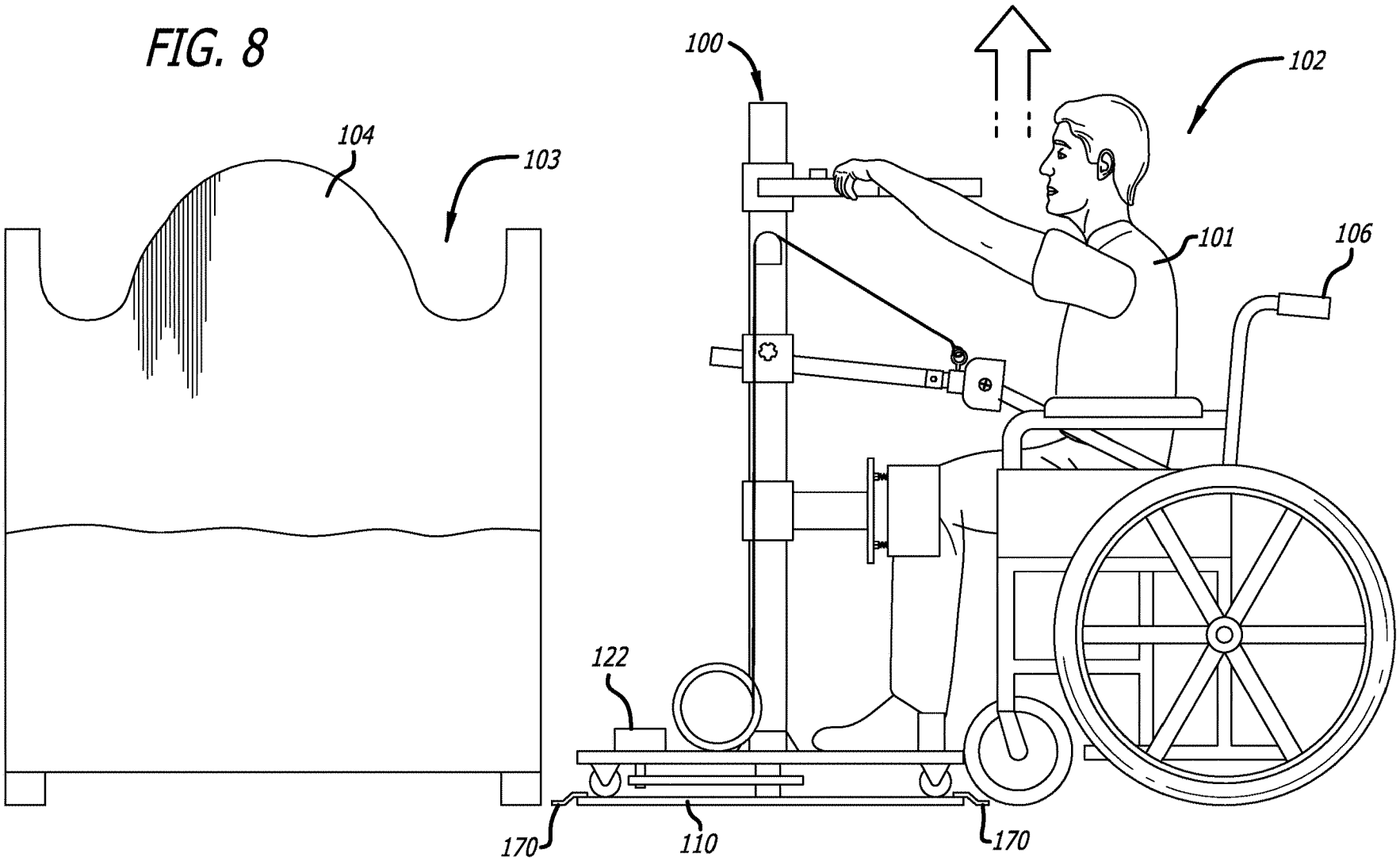
FIG. 8 is a side view of a person in a seated position in a wheelchair at an origination point, near a start of using the system 100 to lift himself to a standing or upright position and rotate himself in order to move to a bed at a destination point.
Figure 9:
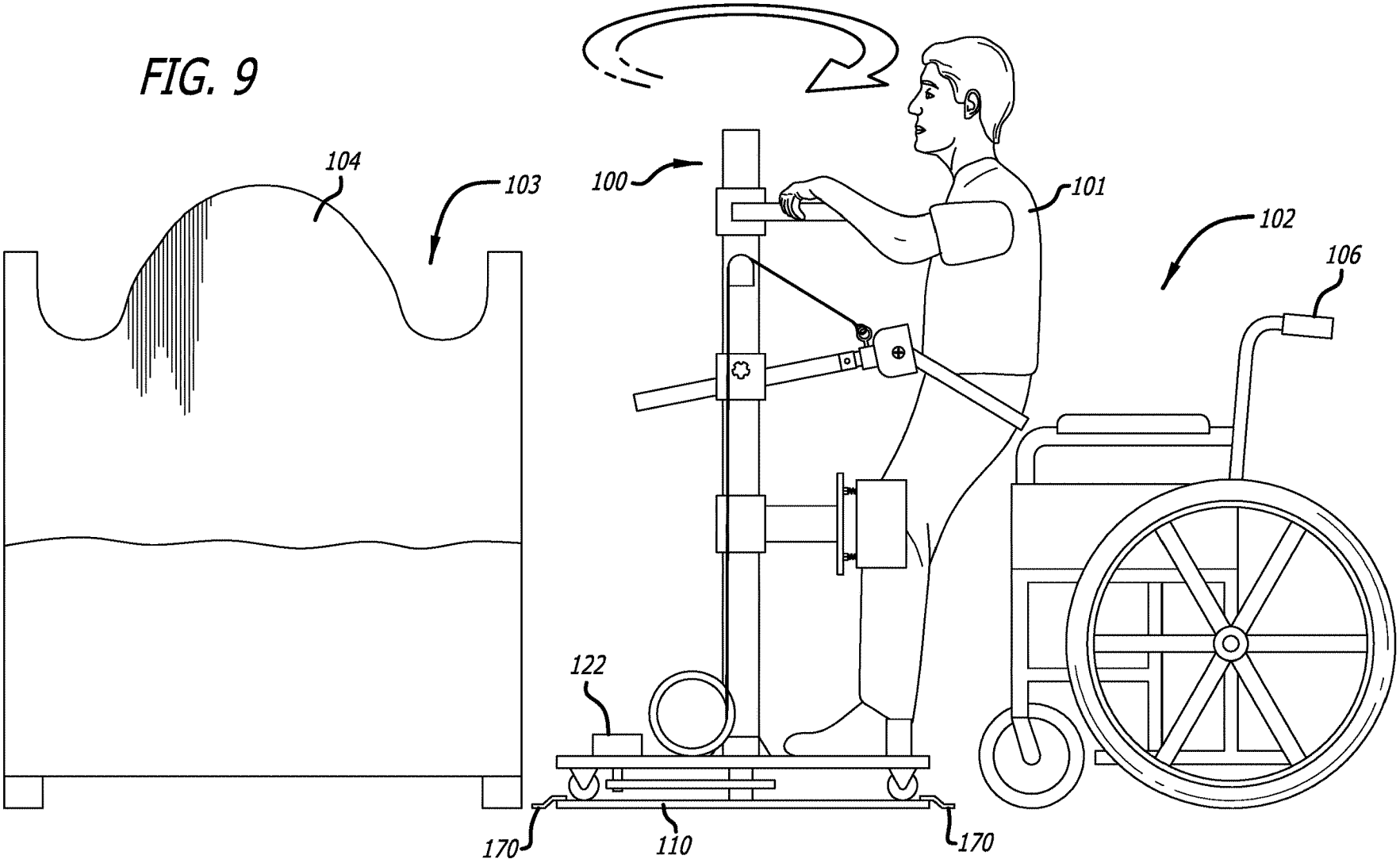
FIG. 9 is a side view of a person lifted to a standing or upright position near a wheelchair at an origination point, near the start of using the system 100 to rotate himself to near a bed at a destination point.
Figure 10:
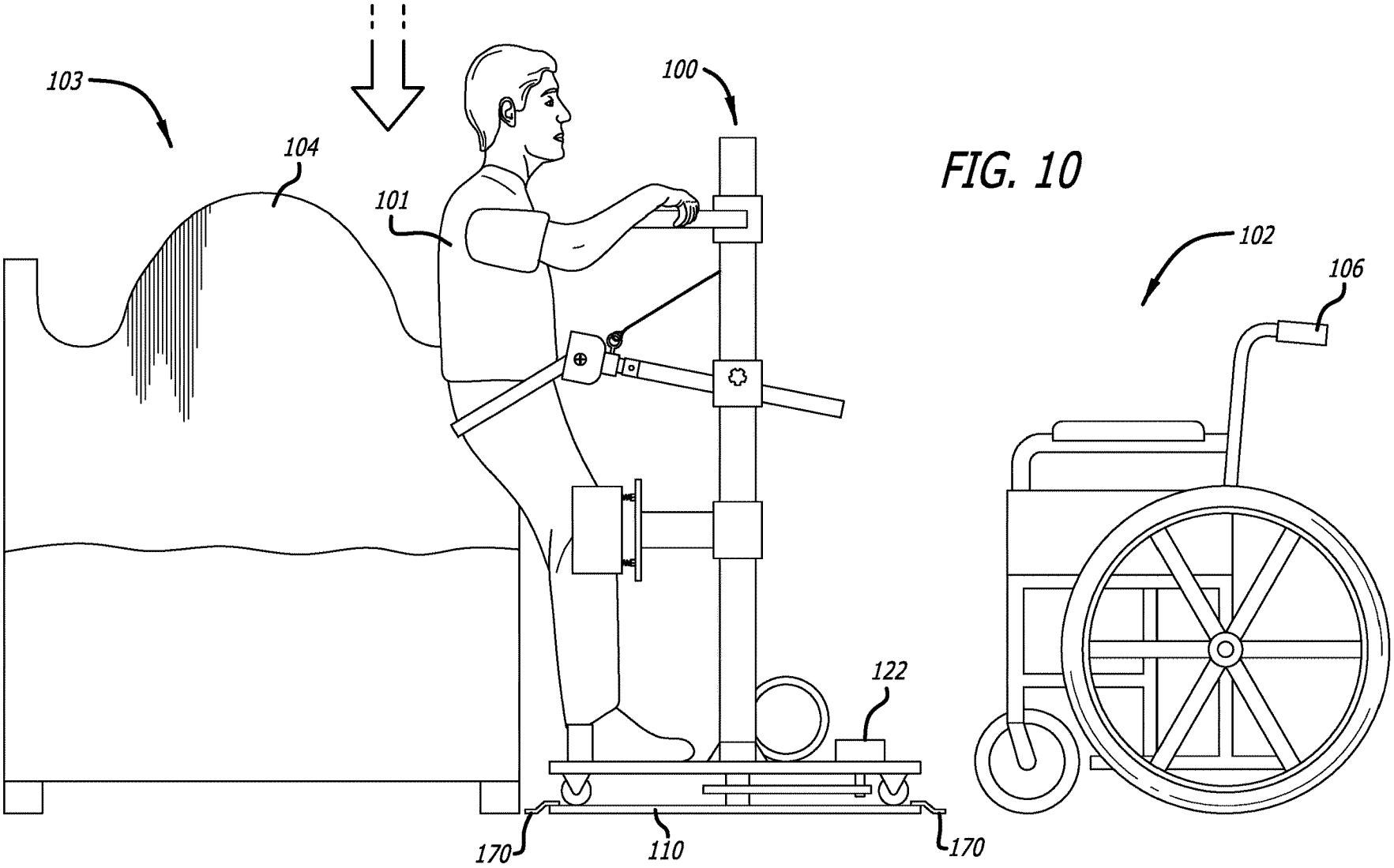
FIG. 10 is a side view of a person in a standing or upright position near a bed at a destination point, near the start of using the system 100 to lower himself to a seated position on the bed at the destination point.
Figure 11:
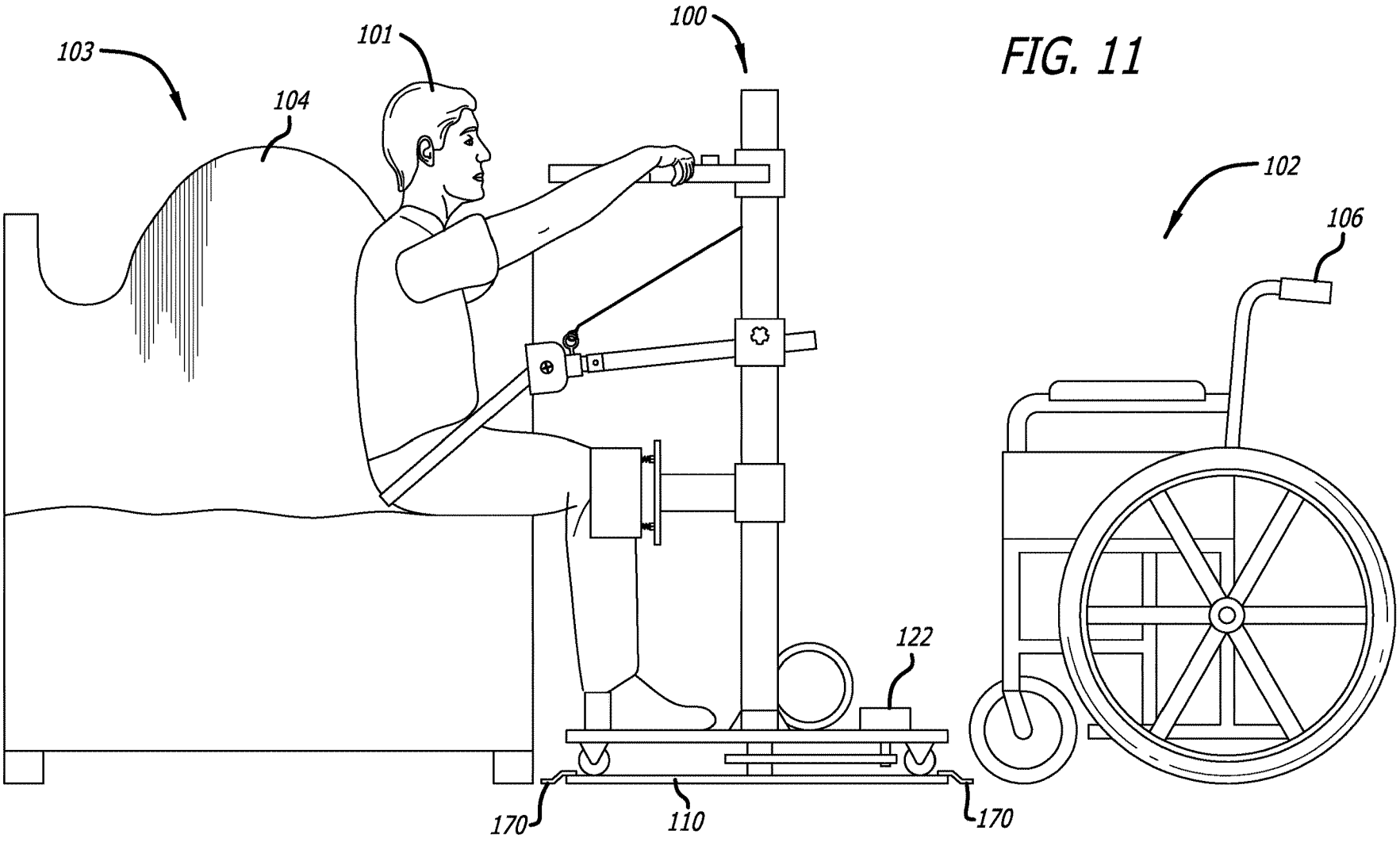
FIG. 11 is a side view of a person in a seated position in a bed at a destination point, near an end of using the system 100 to rotate and lower himself to the seated position in the bed at the destination point.
Figure 12:
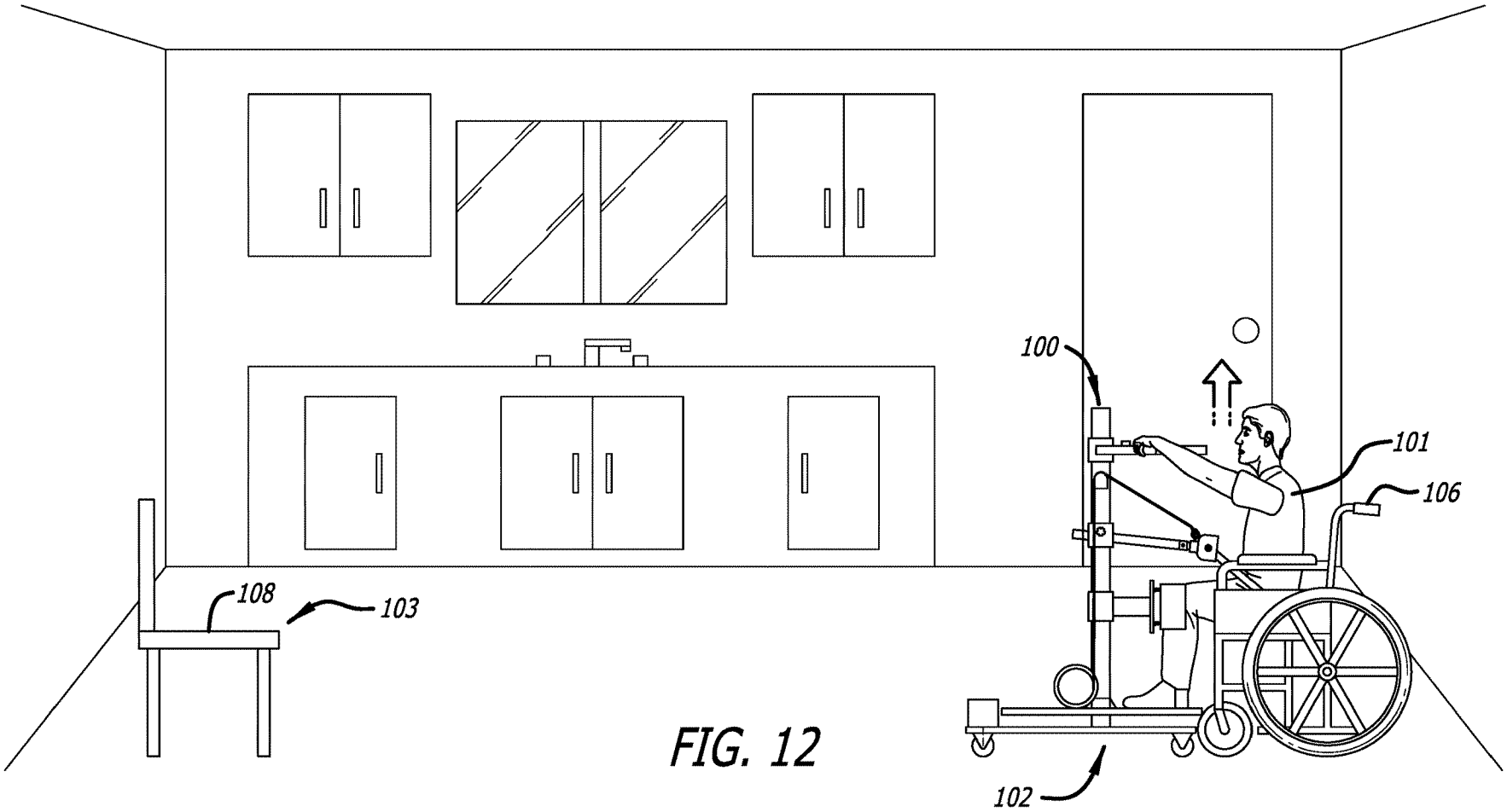
FIG. 12 is a side view of a person in a seated position in a wheelchair at an origination point, near a start of using an embodiment of the system 100 to lift himself to a standing or upright position and rotate himself in order to move to a bed at a destination point.
Figure 13:
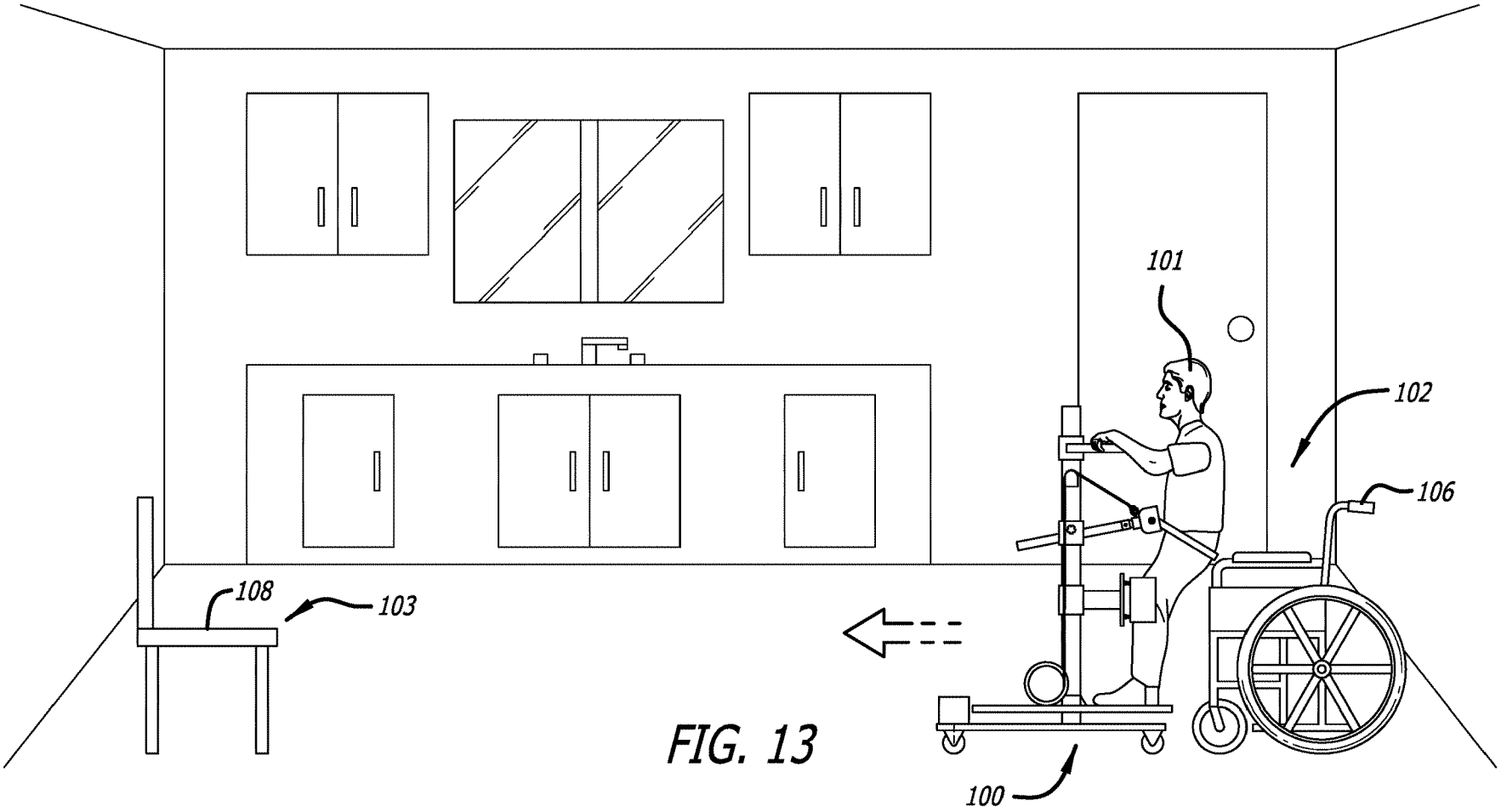
FIG. 13 is a side view of the person lifted to the standing or upright position near the wheelchair at the origination point, near the start of using the system 100 to linearly translate himself to near the bed at the destination point.
Figure 14:
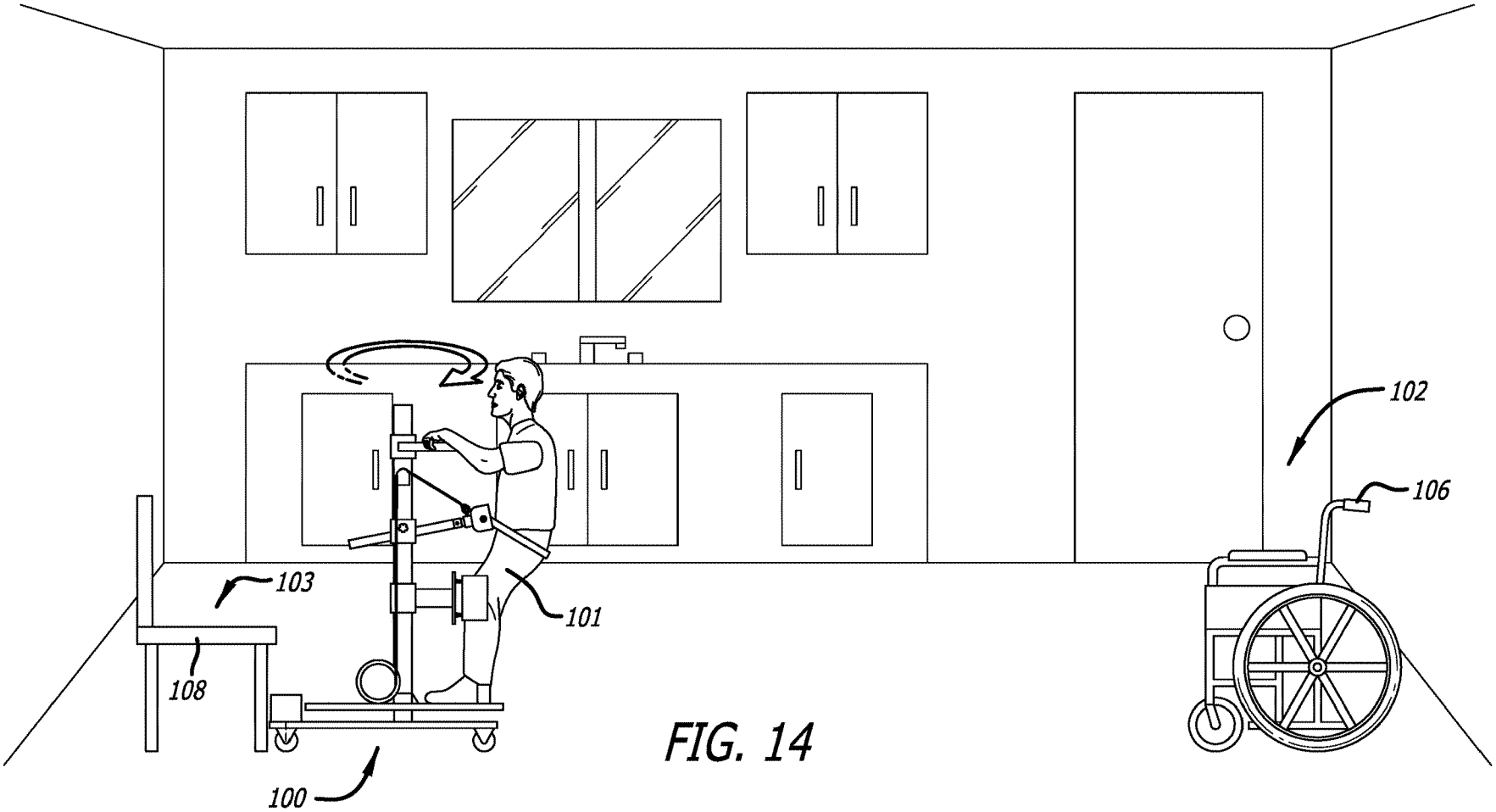
FIG. 14 is a side view of the person in a standing or upright position near a bed at a destination point, near the start of using the system 100 to rotate himself to a standing or upright position near the bed at the destination point.
Figure 15:
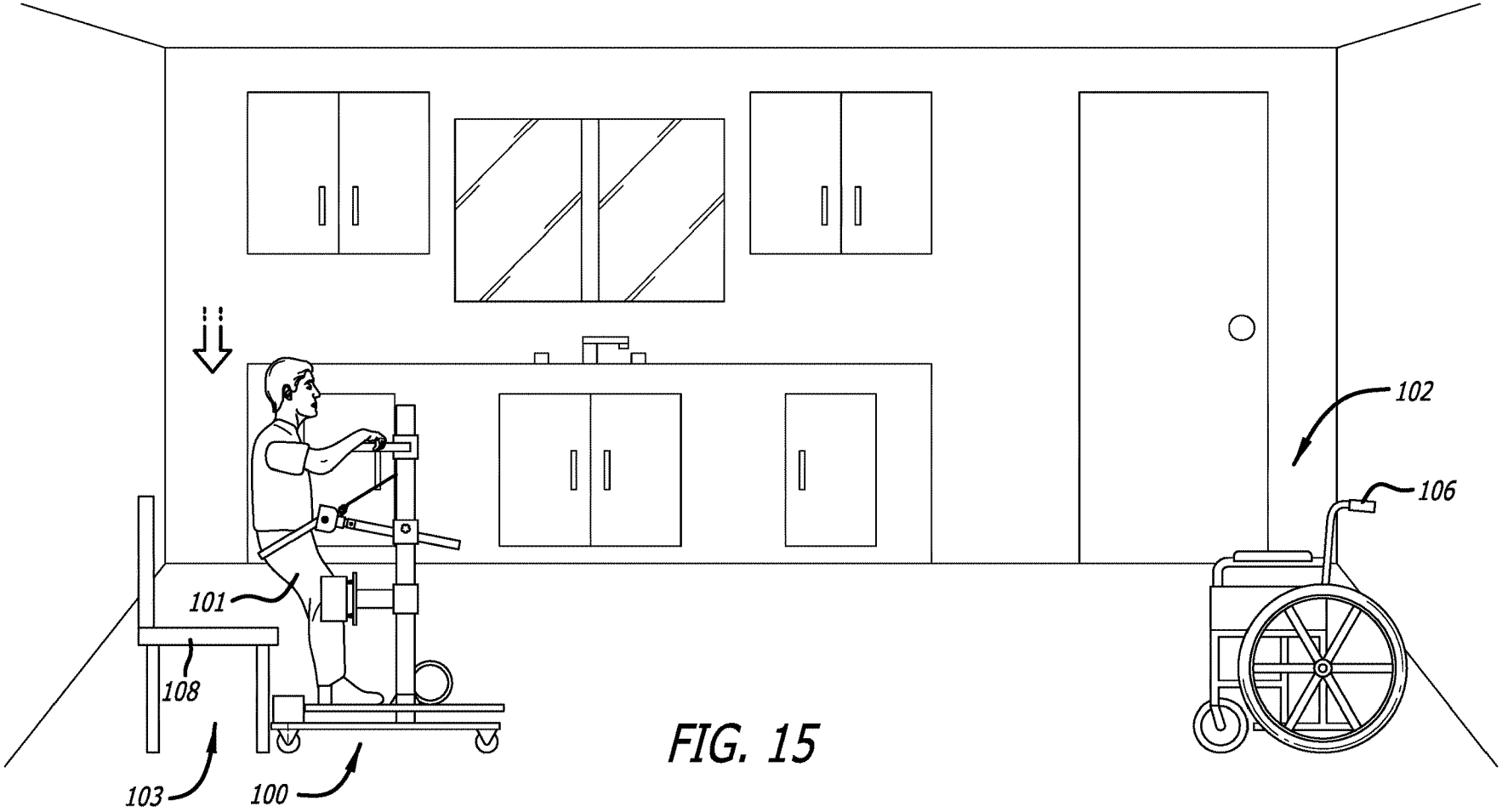
FIG. 15 is a side view of the person in the standing or upright position near the bed at the destination point, near the start of using the system 100 to lower himself to a seated position on the bed at the destination point.
Figure 16:
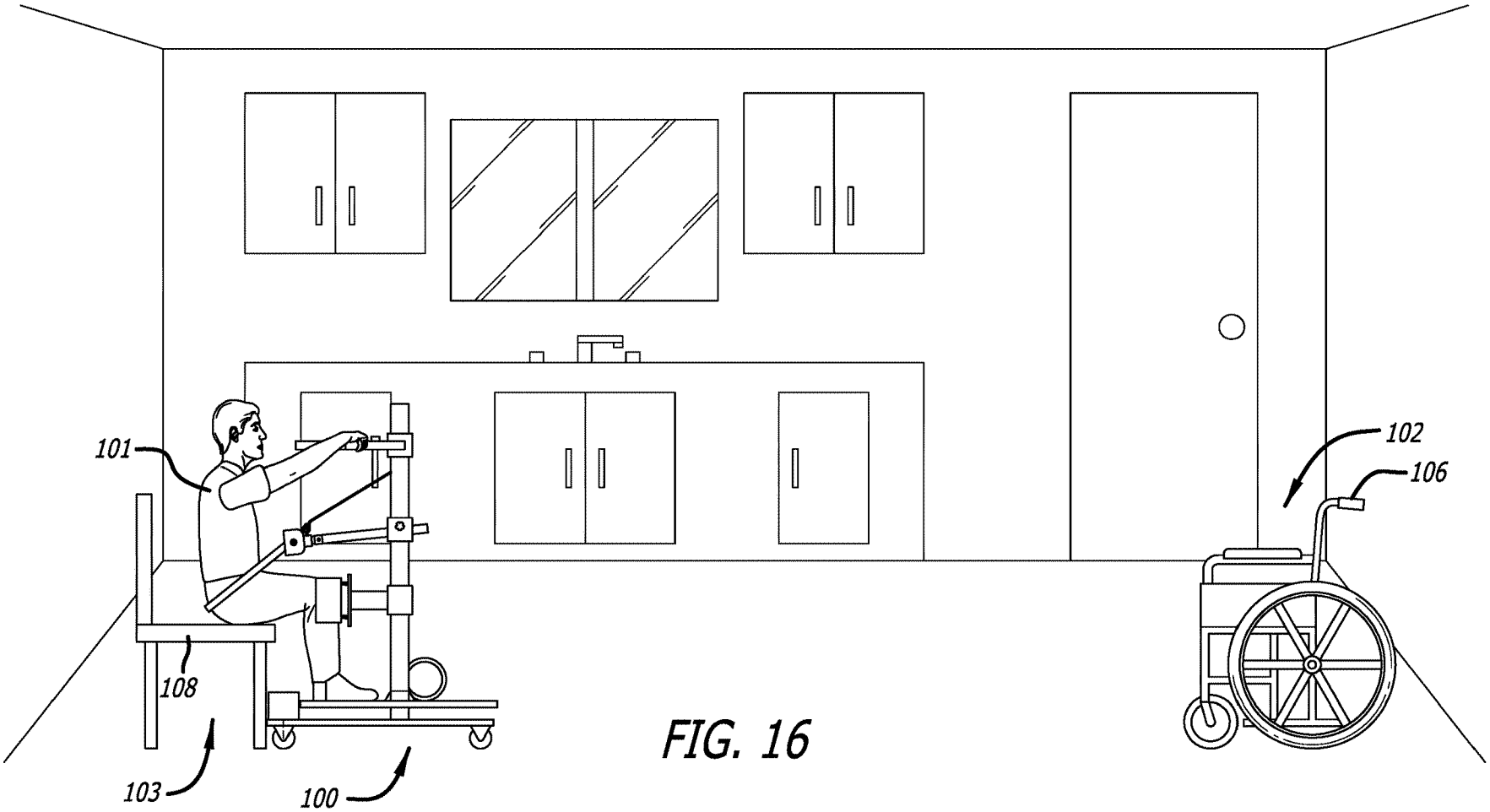
FIG. 16 is a side view of the person in a seated position in the bed at the destination point, near an end of using the system 100 to lower himself to the seated position in the bed at the destination point.
Figure 17:
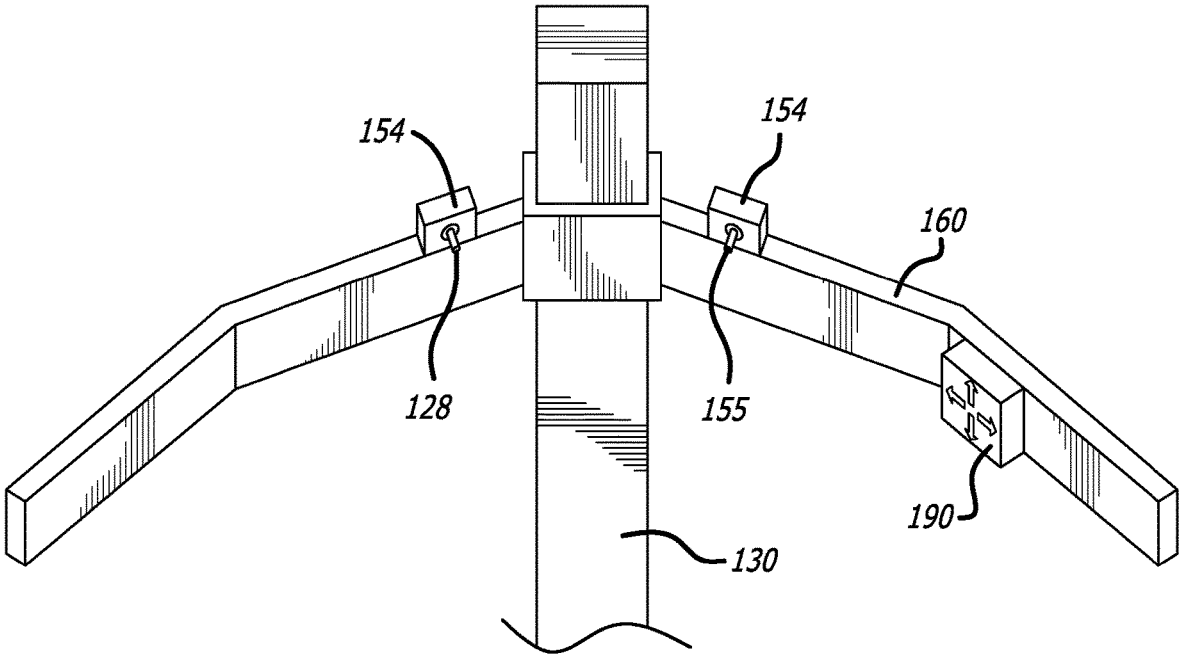
FIG. 17 is a perspective view of the upper portion of the system 100, including the stabilizing handlebars.
Figure 18:
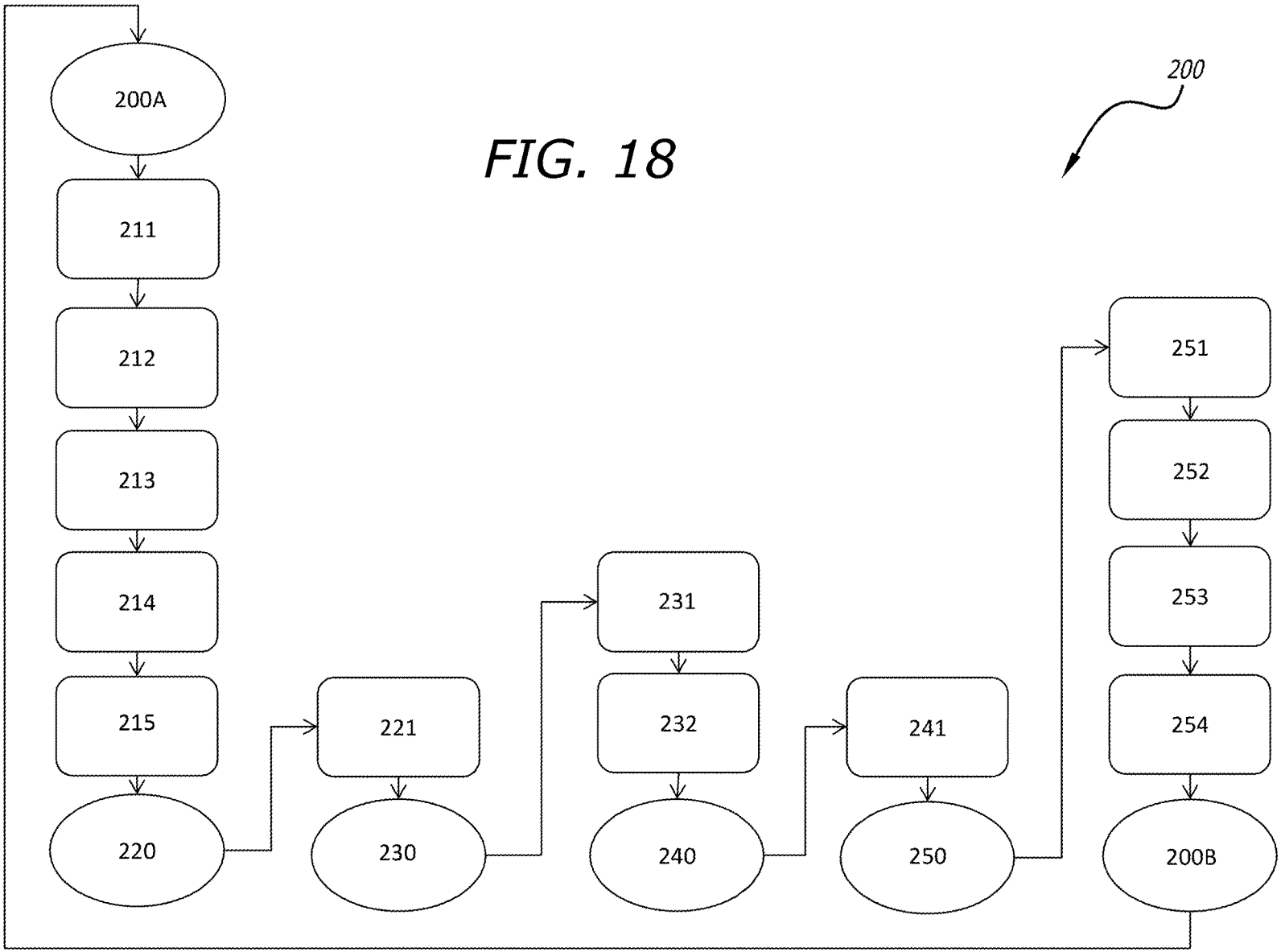
FIG. 18 shows a conceptual drawing of a method.

For example, the user footrests 127 could be disposed in the form of the heel of a shoe, for example as shown in FIGS. 1, 6, and 7.

In alternative implementations, the rotational base plate 120 could include a material or structure capable of supporting another type of user, such as an animal or an object. For example, the animal could be a sedated veterinary patient, or a restrained undomesticated animal disposed for transfer. For example, the object could include an item of sensitive artwork or equipment. While this Application primarily describes movement of a substantially disabled human user 101, in the context of the invention, there is no particular requirement for any such limitation.

Tower

In possible implementations, the tower 130 could include a tower coupling 131, disposed so that the tower 130 could be coupled to the rotational base plate 120. The tower coupling 131 could use one or more of the following to couple the tower 130 to the rotational base plate 120 and to the mounting base plate 110:

The tower coupling 131 could include a centralized hole (shown at the intersection of the rotational base plate 120 and the tower 130) in the rotational base plate 120, with the tower 130 coupled to the rotational base plate 120 at the tower coupling 131. The tower 130 can include a tower casing 132. In one possible embodiment, the tower casing 132 could have the shape of a square pipe, coupled to the mounting base plate 110 by any mechanical technique. The tower 130 (or at least its vertical axis) can also include a substantially vertical tower axle driveshaft 133, disposed inside the tower casing 132.

For example, the vertical tower axle 133 could be enclosed by, and supported by, a bearing. The bearing could support the vertical motor driver, with the effect of rotating the rotational base plate 120 with respect to the mounting base plate 110. The vertical tower axle 133 could also be coupled through the rotational gearing 123, to provide rotational torque to the rotational base plate 120 with respect to the mounting base plate 110.

In possible implementations, the tower 130 could (optionally) be incorporated with a tower stabilizer assembly, disposed so that the tower 130 would be stabilized in a substantially vertical position relative to the rotational base plate 120. The tower stabilizer assembly could include the tower 130 itself and one or more cables or struts coupling the rotational base plate 120 to the tower 130.

For example, the one or more cables could be coupled between a relatively high spot on the tower 130, such as at the top, or near the top, of the tower 130, with the effect of providing tension support. This would have the effect that if the tower 130 were to sway relative to the rotational base plate 120, the tension support provided by the one or more cables would resist the motion of the tower 130, and would stabilize the tower 130 with respect to the rotational base plate 120.

For example, the one or more struts could be coupled between the relatively low spot on the tower 130, such as near the bottom of the tower 130, with the effect of providing structural support. This would have the effect that if the tower 130 were to bend relative to the rotational base plate 120, the structural support provided by the one or more struts would resist the motion of the tower 130, and would stabilize the tower 130 with respect to the rotational base plate 120.

Thus, the cables or struts can exert a stabilizing force on the tower 130, maintaining the tower 130 substantially stable and substantially vertical relative to the rotational base plate 120.

The particular cables used in the tower stabilizer assembly are substantially distinct from the lifting/lowering element assembly 150, which can also include one or more cables coupled to the top, or near the top, of the tower 130. The cables in the lifting/lowering element assembly 150 instead can provide the effect of having the effect of lifting or lowering the user 101 between a sitting and standing position. The one or more cables used with the lifting/lowering element assembly 150 preferably are distinct cables.

The stabilizing handlebars 160 can also be substantially distinct from the tower stabilizer assembly. In a preferred embodiment, the stabilizing handlebars 160 do not provide any stabilizing effect for the tower stabilizer assembly. Instead, they have the primary effect of providing comfort and stability to the user 101 during the lifting/lowering process.

The horizontal stabilizer assembly 144 can also be substantially distinct from the tower stabilizer assembly. As described herein, the horizontal stabilizer assembly 144 can include sub-elements, and can have the effect of providing comfort and horizontal stability to the user 101. The horizontal stabilizer assembly 144 can also include a horizontal mounting point coupled to the tower casing 132, which can be adjusted in height for suitability to the user number 101. For example, the tower casing 132 can be disposed for sliding up or down, preferably with a height setting such as a pin or a friction bearing to prevent slippage. The horizontal mounting point 145 can be coupled to the tower 130 using a pin 146 engaging the mounting point 145 with the tower casing 132, with the horizontal mounting point 145 including a horizontal stabilizer element or stabilizing bar holder 144*c*, with the effect of maintaining the horizontal stabilizer assembly 144 substantially horizontal, that is, it prevents the horizontal stabilizer element or stabilizing bar holder 144*c* from tipping either clockwise or counterclockwise. In a preferred embodiment, this can be an effect of shaping the horizontal stabilizer element or stabilizing bar holder 144*c* in a rectangular box shape, preferably one with a height/width ratio of substantially greater than 1.0, suitable to fit a substantially similar rectangular box shape of a harness bar coupling or stabilizing bar 144*b*; the harness bar coupling or stabilizing bar 144*b* is suitable to couple the user harness bar or horizontal stabilizer bar 144*a* to the tower 130. This can have the effect that any attempt to tilt the harness bar or horizontal stabilizer bar 144*a* would be resisted by resistive contact between the horizontal stabilizer element or stabilizing bar holder 144*c* and the harness bar coupling or stabilizing bar 144*b*. Moreover, the harness bar coupling or stabilizing bar 144*b* can be disposed to slide through the horizontal stabilizer element or stabilizing bar holder 144*c*, with the effect that the user's position can be adjusted closer or further when using the lifting/lowering element assembly 150. Other and further elements are described herein.

User Harness

In possible implementations, the user harness assembly 140 could be disposed so that the user 101 could be seated, or otherwise stabilized, while moving between a sitting and standing position. For example, the user harness assembly 140 could include a user seat, or similar equipment, such as might be disposed below the user 101, or between the user's legs, and is suited to support the user 101 while moving between a sitting and standing position. For example, the user harness assembly 140 can include the user seat, coupled to the lifting/lowering element assembly 150, and with the user 101 secured by a seat belt, disposed so that the user 101 could rest while moving between a sitting and standing position. In such cases, the user seat can include a flat-bed assembly upon which the user 101 can sit, an optional seat back and an optional set of set arms. In such case, the user seat can alternatively include a plastic seat into which the user can secure their arms or legs, with the effect of securing the user 101 against falling.

The seat belt can be fully detachable, or can be coupled to the user seat, and can further secure the user 101 against falling. The seat belt can be coupled around the user's midsection, and can be coupled to the horizontal stabilizer assembly 144. This can have the effect that when the lifting/lowering element assembly 150 is engaged, the horizontal stabilizer assembly 144 is coupled to the user seat (and possibly also to the seat belt), the user 101 is secured against falling, whether falling out of the user seat, or falling against the lifting/lowering element assembly 150.

For example, the user harness assembly 140 could include a horizontal stabilizer assembly 144 including a user harness compressor 141 (sometimes also referred to herein as spring sensors), as described above, and appearing in FIG. 4 as a bar coupled to the tower 130. This can have the effect that when the user 101 is lifted to a standing position, the user 101 can lean against the user harness compressor 141, with the effect of providing support to the user 101 and preventing the user 101 from crashing into the tower 130. In possible implementations, the user harness compressor 141 could include springs, which could have the effect of both softening pressure between the user 101 and the user harness compressor 141.

In possible implementations, the user harness assembly 140 could alternatively include a tray, one or more climbing carabiners, one or more hooks, or other equipment suitable for hoisting the user 101. In such cases, the tray can include a flat surface onto which the user 101 can place objects the user 101 desires to move with themselves from the origination point 102 to the destination point 103.

In possible implementations, the tower 130 could include one or more user knee-pads 143, disposed so that the user 101 could lean against the tower 130 when moving between a sitting and standing position.

For example, the user knee rests 143 could be disposed so that the user 101 could lean or squat into the tower 130 while moving between a sitting and standing position. This has the effect that the user's knee (or knees, if there is more than one user kneepad 143) could be cushioned against damage or pain while the user 101 exerts weight against the tower 130. For example, the user knee rests 143 could be shaped to guide and stabilize the user's knees, and could be cushioned with a relatively thick layer of padding, such as made of cotton or other soft and resilient material. The height of the knee rests 143 is adjustable on the tower 130. A height adjust 147 engages the tower 130, holding the knee rests 143 at a particular vertical position.

In possible implementations, the tower 130, user harness assembly 140, or lifting/lowering element assembly 150 could include guiding elements that prompt or guide the user's legs into the user knee rests 143, which could have the effect that the user 101 does not adopt an untoward posture or positioning when being lifted or lowered.

In possible implementations, the tower 130 could include one or more user handholds, disposed so that the user 101 could stabilize themselves while leaning against the tower 130, such as when moving between a sitting and standing position.

In possible implementations, the lifting element assembly 150 could be disposed between a relatively higher spot on the tower 130 (such as the top of the tower 130) and the user harness assembly 140. This could have the effect that the lifting element assembly 150 could exert a lifting force on the user harness assembly 140, toward the relatively higher spot on the tower 130. For example, the lifting element assembly 150 could include a lifting cable 153 or a chain, wire, rope (the rope including cloth, leather, wire, or other suitable material) having sufficient tensile strength to withstand the user's weight. For example, the lifting cable 153 could be anchored to the user harness assembly 140, and could also be anchored to about a pulley 156 at the relatively higher spot on the tower 130 near the stabilizing handlebars 160.

For example, the lifting cable 153 could be coupled to a lifting motor driver 151, disposed so that the lifting motor driver 151 could lengthen or shorten the lifting cable 153. This could have the effect that the lifting cable 153 could lower (when lengthened) or raise (when shortened) the user 101 with respect to the rotary base plate 120. For example, the lifting motor driver 151 could include a lifting motor 152, disposed within reach of the user 101 whether in a sitting or standing position.

This could have the effect that the user 101 could operate the control element 154 using the lifting/lowering control switch 155 to lower or raise themselves when moving between a sitting and standing position.

Stabilizing Handlebars

In one possible implementation, the user 101 can take hold of the stabilizing handlebars 160 while being lifted from a sitting to standing position, or lowered from a standing to sitting position. For example, the stabilizing handlebars 160 could be disposed near the top of the tower 130, which could have the effect that the user 101 could stabilize themselves during transition to a standing position (whether or not the user 101 intended to maintain that standing position).

Method of Use

Figure 2:
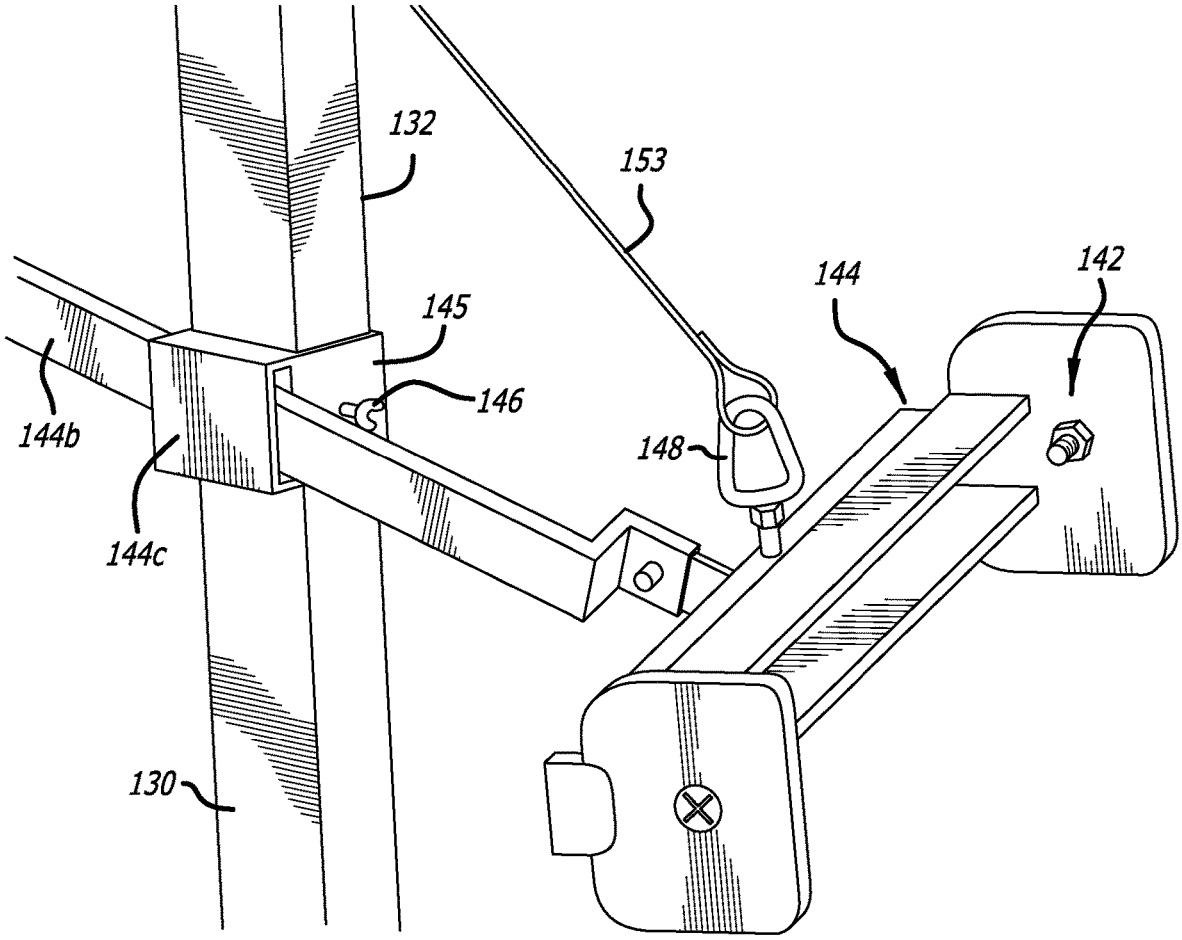
FIG. 2 is a perspective view of a horizontal stabilizer assembly of the system of FIG. 1.
Figure 3:
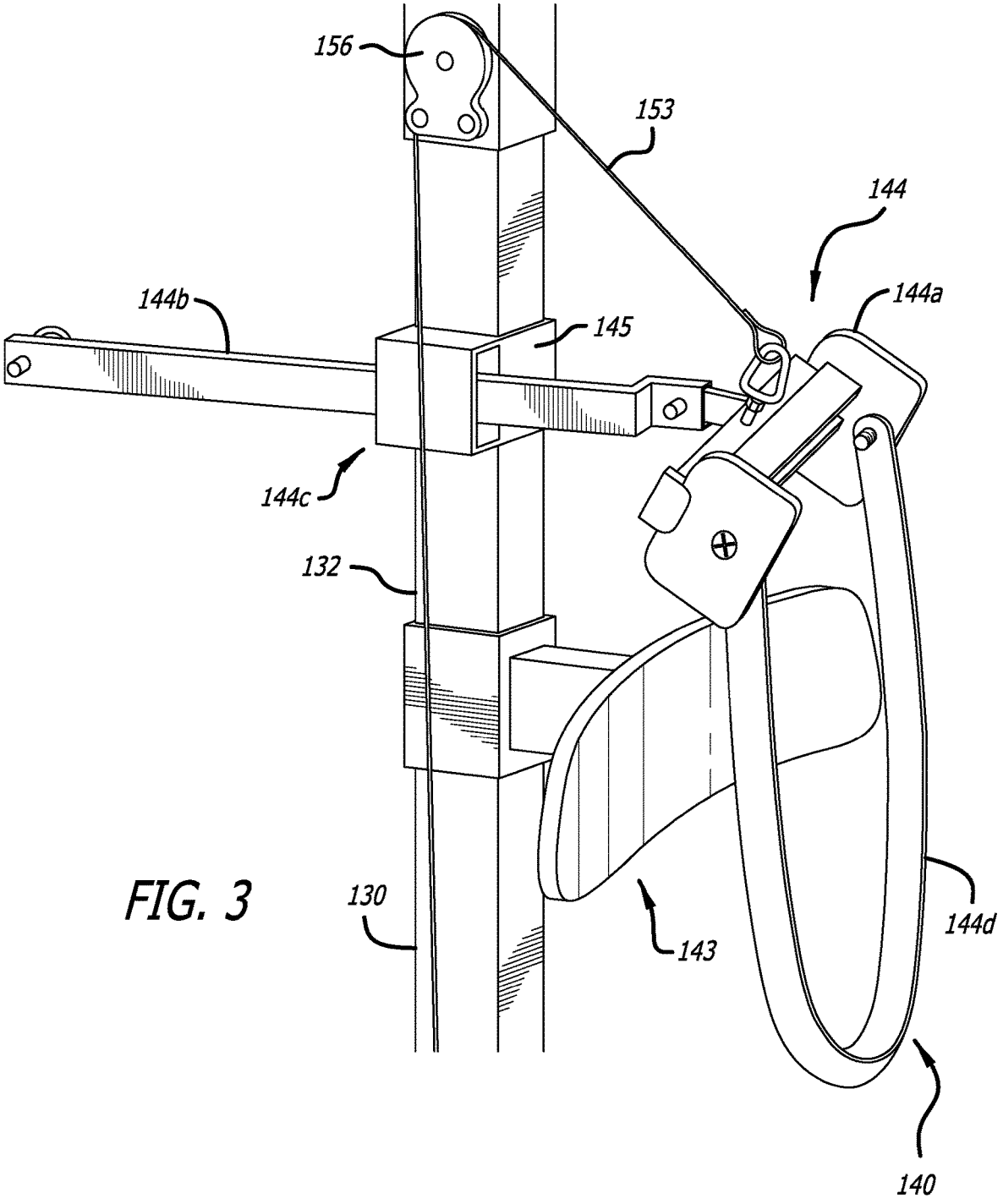
FIG. 3 is a perspective view of the system of FIG. 1 with a knee rest assembly and a harness connected to the horizontal stabilizer assembly.
Figure 4:
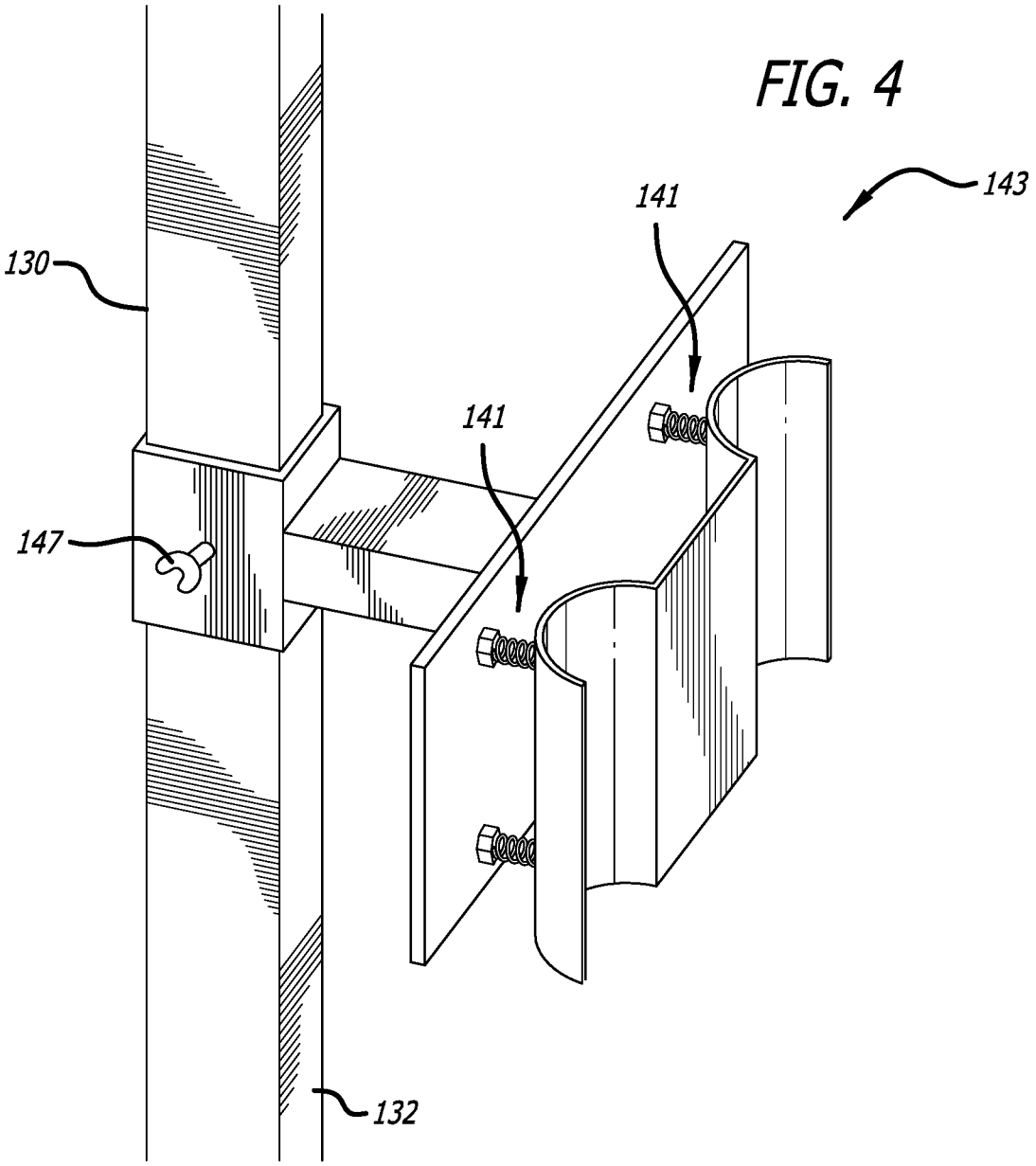
FIG. 4 is a perspective view of a knee rest assembly of the system of FIG. 1.

FIG. 2 shows a conceptual drawing of a method.

In possible implementations, a method 200 includes flow points and method steps as described herein, other elements shown in the figure, and possibly other elements. Not all flow points or method steps are required. Flow points or method steps should be considered optional, unless otherwise specified or unless clearly obvious for operation of the system.

The system 100, or portions of the system 100, can be used while performing the method 200, or portions of the method 200. Where described herein that a flow point is reached, or a step is performed, by the method 200, it should be understood from the context, or from the figure, which portions (or all of them) of the system 100, reaches the flow point or takes the actions to perform the step.

Although the nature of text necessitates that the flow points and steps are shown in a particular order, in the context of the invention, there is no reason for any such limitation. The flow point may be reached, and the steps may be performed, in a different order, or may be performed by co-routines or recursive functions, or may be performed in a parallel or pipelined manner, or otherwise.

Although this Application primarily describes lifting the user 101 from a sitting position (an origination point 102) to a standing position (a destination point 103), the machines, methods, articles of manufacture, and other inventive techniques described herein can be used to move the user 101 in other ways:

The techniques described herein can be used to move the user 101 in a reverse manner, that is, from a standing position (an origination point 102) to a sitting position (a destination point 103).

The techniques described herein can be used to move the user 101 from a lying-down position (an origination point 102) to a sitting position (a destination point 103), or the reverse, from a sitting position (an origination point 102), to a lying-down position (a destination point 103).

The techniques described herein can be used to move the user 101 from a standing position in one location (an origination point 102) to another location (a destination point 103), and the reverse, with the effect of providing the user 101 a method of transport between the origination point 102 and the destination point 103, and back.

Flow Points and Method Steps

Ready to Start

A flow point 200A indicates that the method 200 is ready to start. For example, the user 101 could desire to move between a sitting and standing position, or between other positions. The method 200 is described below with respect to the user 101 operating the system 100 to move from a sitting to standing position. This could have the effect of lifting, or assisting the user 101 to lift, the user 101 from a sitting to a standing position. However, the same or similar flow points and method steps could be performed in substantially reverse order. This could have the effect of allowing the user 101 to operate the system 100 in substantially reverse order, to move from a standing to a sitting position.

The method proceeds with the flow point 211.

Initial Positioning

At a step 211, in one example, the user 101 begins in a sitting position. For example, the user 101 could be sitting in a wheelchair as the origination point 102. In such cases, the destination point 103 could be located nearby. If the user 101 is not already sitting in the origination point 102, at this step, the user 101 positions themself at the origination point 102.

At a step 212, the user 101 places one or more of their feet in the one or more user footrests 127. This could have the effect that the user 101 could stabilize themselves while in a standing position near the tower 130.

At a step 213, the user 101 places one or more of their knees on the one or more user knee rests 143. This could also have the effect that the user knee rests 143 could ameliorate any pain that the user 101 might feel as a result from leaning against the tower 130. Some adjustment might be required. For example, the user knee rests 143 can be mounted onto the tower 130 using spring-loading elements 141, with the effect that the user knee rests 143 are aligned with the user's knees.

At a step 214, the user 101 places themself in the harness 144*d* of the user harness assembly 140. For example, the harness 144*d* of the user harness assembly 140 can include a harness seat consisting of a soft and flat surface (similar to a child's swing seat), and one or more fasteners disposed to buckle the harness belt 144*d* to encapsulate and secure the user 101 for the lifting process. For another example, the harness assembly 140 could include a harness belt 144*d* consisting of a soft material (such as cloth, leather, webbing, or padded metal), with the harness belt 144*d* coupleable to the tower 130. In such cases also, the harness assembly 140 can include one or more fasteners disposed to buckle the harness belt 144*d* to encapsulate and secure the user 101 for the lifting process.

As part of this step, the user 101 could determine that all fasteners are coupled, and that the harness assembly 140 is secured.

At a step 215, the user 101 couples the harness 144*d* of the user harness assembly 140 to the linkage. For example, the harness assembly 140 could include a further fastener 148 that can be coupled to the lifting/lowering element assembly 150. As part of this step, the user 101 could determine that the further fastener 148 is in fact coupled to the lifting/lowering element assembly 150, and that the coupling is sufficiently strong to lift the user 101.

The method 200 proceeds with the flow point 220.

Lifting the User

At a flow point 220, the method 200 is ready for the system 100 to lift the user 101.

At a step 221, the user 101 operates the system 100 to lift themselves from the sitting position at origination point 102 to a leaning or standing position near the tower 130 (such as leaning against, or standing adjacent to, the tower 130). The user 101 could accomplish this using one or more of several techniques:

The user 101 could operate the lifting/lowering element to lift the user harness assembly 140. This could have the effect that the user 101 is also lifted, to the point where the user 101 is moved to the leaning or standing position near the tower 130.

For example, the user 101 could operate the lifting motor 152 and the lifting motor driver 151, to cause the system 100 to lift the user 101. For example, the user 101 could also operate the control element 154, using the control pad and the control coupling, to direct the lifting motor 152 to either lift or lower the user 101.

The method 200 proceeds with the flow point 230.

Rotating the Base

At a flow point 230, the method 200 is ready for the system 100 to move the user 101, such as by rotation or translation, to the destination point 103.

At a step 231, the user 101 grasps the stabilizing handlebar 160 to stabilize themself while standing. Grasping the stabilizing handlebar 160 helps to secure the user 101 while the rotational base plate 120 is rotating. Grasping the stabilizing handlebar 160 helps to secure the user 101 while the rotational base plate 120 is moving in a translational manner. This could have the effect that the user 101 is substantially stabilized in the leaning or standing position leaning against or standing next to the tower 130.

At a step 232, the user 101 operates the system 100 to rotate or translate their position from substantially adjacent to the origination point 102 to substantially adjacent to the destination point 103. The user 101 could accomplish the rotation or translation using one or more of the following techniques:

For example, the user 101 could operate the control element 154 using the control pad, to cause the rotational motor 122 to turn the rotational base plate 120. This could have the effect that the user 101 is substantially moved, while in the leaning or standing position, from near the origination point 102 to near the destination point 103.

For example, when the user 101 operates the control element 154 using the control pad, the rotational motor 122 can cause the rotational base plate 120 to rotate. This could have the effect that the position of the rotational base plate 120, moves relative to the origination point 102 and relative to the destination point 103.

For example, the user 101 could alternatively operate the control element 154, using the control pad, to direct a translational motor to move the rotational base plate 120, as described above, with the effect of moving the user 101 in a translational manner from near the origination point 102 and to near the destination point 103. Although this Application primarily describes the method 200 by moving the user 101 in a rotational manner, a translational motor can be disposed to move the rotational base plate 120 in a translational manner, similar to the rotational motor, on bearings such as wheels or casters.

The method 200 proceeds with the flow point 240.

Lowering the User

At a flow point 240, the method 200 is ready for the system 100 to lower the user 101. For example, the method can perform a substantial inverse of the step 221 described above.

At a step 241, the user 101 operates the system 100 to lower themselves from the leaning or standing position near the tower 130 to the sitting position in the destination point 103. The user 101 could accomplish this using one or more of several techniques:

The user 101 could operate the control element 154 to direct the lowering motor 152 to lower the user harness assembly 140 (i.e., lifting motor 152 lowers as well as lifts). This could have the effect that the user 101 is also lowered, to the point where the user 101 is moved to the sitting position in the destination point 103. In alternative embodiments, the lowering motor 152 could be replaced or assisted by a lever or pincer assembly (not shown), with which the user 101 to exert physical force without use of a motor.

For example, the user 101 could turn a wheel to lengthen the lowering cable 153. For example, the user 101 could also operate the control element 154, using the control pad 151 and the control coupling, to direct the lowering motor 152 to similarly operate the lowering cable 153.

The method 200 proceeds with the flow point 250.

Final Positioning

At a flow point 250, the method 200 is ready for the system 100 to finally position the user 101 in the sitting position in the destination point 103.

At a step 251, the user 101 begins in the leaning or standing position near the tower 130. In such cases, the destination point 103 should now be located nearby. At part of this step, the user 101 positions themselves relative to the destination point 103.

At a step 252, the user 101 removes the harness from the lowering cable 153. If the user harness 140 is relatively easily removed after the user 101 has placed themselves in the sitting position in the destination point 103, the user 101 performs the step 253 followed by the step 254. If the user harness 140 is not so easily removed in such cases, the user 101 performs the step 254 followed by the step 253. For example, if the user harness 140 includes a harness seat consisting of a soft and flat surface (similar to a child's swing seat), and can be easily removed from under the user 101 after being unfastened, the method 200 could proceed as in the former case. Otherwise, the method 200 could proceed as in the latter case.

At a step 253, the user 101 uncouples the user harness 144*d* of the user harness assembly 140 from the lowering cable 153, substantially reversing the step 213 described above. In the alternative possible implementation noted above, the user 101 could uncouple the pincer, substantially reversing the alternative possible step described above.

At a step 254, the user 101 removes their one or more feet from the one or more user footrests 127, substantially reversing the step 212 described above. As part of this step, the user 101 could also remove their one or more knees from the one or more user knee rests 143, substantially reversing the step 213 described above (but without inducing the ameliorated pain).

The method 200 proceeds with the flow point 200B.

Method Completed

A flow point 200B indicates that the method 200 has been completed.

In possible implementations, the user 101 could repeat the method 200 to move to another location, or to move between a sitting and standing position, or between other positions. For example, the user 101 could move from the destination point 103 back to the origination point 102.

When the user 101 desires to repeat the method 200, the method 200 proceeds with the flow point 200A.

Alternative Embodiments

Similar Elements or Steps

Individual elements or method steps of the described embodiments could be replaced with substitutes that perform similar functions in other contexts.

Elements of the system are described herein with respect to one or more possible embodiments, and are not intended to be limiting in any way. In the context of the invention, there is no particular requirement for any of the specific limitations described with respect to any of the elements of the system. For one example, individual elements of the described apparatuses could be replaced with substitutes that perform similar functions. Moreover, as described herein, many individual elements of the described apparatuses are optional, and are not required for operation.

Moreover, although control elements of the one or more described apparatuses are described herein as being executed as if on a single computing device, in the context of the invention, there is no particular requirement for any such limitation. For one example, the control elements of the one or more described apparatuses can include more than one computing device (or more than one specialized computing device), not necessarily all similar, on which the element's functions are performed.

For one example, while some embodiments are generally described herein with respect to specific steps to be performed by generalized computing devices, in the context of the invention, there is no particular requirement for any such limitation. In such cases, subject matter embodying the invention can include special-purpose devices; and can include special-purpose hardware devices having the elements described herein, and having the effect of performing the steps described herein; and combinations and/or conjunctions thereof. Embodiments of the invention are not necessarily limited to computing devices, but can also include any form of device or method that can improve techniques for improving the effect of the machine operations described herein.

In one particular implementation, instructions capable of being interpreted for control of devices can be provided as a computer program product, such as instructions that are maintained on a computer-readable storage medium or a non-transitory machine-readable medium. The non-transitory medium can include a magnetic, optical or magneto-optical storage medium; a flash storage medium; and/or otherwise.

Specification Not Limiting

After reading this Application, those skilled in the art would recognize that the invention is not limited to only the specifically described embodiments, that many variations are within the scope and spirit of the invention, and would be workable without undue experiment or further invention.

Claims Included in Specification

The Claims in this Application are hereby included by reference in the text of the Specification.

The invention claimed is:

1. Apparatus disposed to move a user without assistance, the apparatus including, a horizontal stabilizer assembly including a harness sized so that the user can be lifted by said harness to a standing position;

a vertical tower, wherein the horizontal stabilizer assembly engages the vertical tower;

a lifting/lowering element assembly including a lifting/lowering motor, and a lifting/lowering cable directly engaging the horizontal stabilizer assembly, wherein the lifting/lowering motor engages the lifting/lowering cable to lift/lower the harness;

a movable device coupled to said lifting/lowering element assembly, said movable device including a base sufficiently stable that the user can lean or stand on the base;

a tower coupling generally disposed at top center of the base, wherein the tower coupling includes a centralized hole into which the vertical tower extends, wherein the vertical tower is coupled to the base at the tower coupling, and wherein the vertical tower is stationary relative to the base;

a moving element coupled to the movable device, said moving element subject to the control of the user; wherein the base is rotatable relative to the movable device about an axis of rotation; wherein the moving element includes a rotational motor operationally engaging the base to provide motorized rotational movement of the base in a controlled manner; and wherein the moving element includes a translational motor operationally engaging the moveable device for providing motorized translational movement of the moveable device in a controlled manner.

2. Apparatus as in claim 1, including one or more footrests disposed on the base to stabilize the user when transitioning between a sitting position and a standing position.

3. Apparatus as in claim 2, wherein said footrests being disposed on one or more of: the base, a relatively lower portion of the lifting/lowering element assembly.

4. Apparatus as in claim 1, including one or more knee rests extending from the vertical tower, wherein the knee rests are disposed to receive the user or the user's weight when transitioning between a sitting position and a standing position.

5. Apparatus as in claim 4, wherein the one or more knee rests are disposed to guide one or more of the user's legs into position for operation of the lifting/lowering element assembly.

6. Apparatus as in claim 1, wherein the base is disposed to bear the weight of the user, the base being coupled to the lifting/lowering element assembly at a location that allows the base to rotate, with an axis of rotation including the lifting/lowering element assembly and at least one spot on the base being at a maximum distance of rotation from said axis of rotation; the moving element includes a translational motor operationally engaging the base to provide motorized translational movement of the base in a controlled manner, and performs translational movement for a distance longer than its maximum distance of rotation.

7. Apparatus as in claim 1, wherein the harness is disposed to seize the user from a location including one or more of: a bed or table, a chair or wheelchair, a sitting position; the moving element is disposed to rotate about an axis of rotation; the harness is disposed to deposit the user to a location including one or more of: a bed or table, a chair or wheelchair, a sitting position.

8. A method, including steps of coupling a lifting/lowering mechanism to a user, at a first object, wherein the lifting/lowering mechanism operationally engages a vertical tower, using the lifting/lowering mechanism to lift the user from a first sitting position to a first leaning or standing position on a rotatable base, wherein a tower coupling is generally disposed at top center of the rotatable base, wherein the tower coupling includes a centralized hole into which the vertical tower extends, wherein the vertical tower is coupled to the base at the tower coupling, and wherein the vertical tower is stationary relative to the rotatable base, rotationally moving the user and the lifting/lowering mechanism together about an axis of rotation by motorized rotation of the base, from the first leaning or standing position to a second leaning or standing position, near a second object, and using the lifting/lowering mechanism to lower the user from the second leaning or standing position to a second sitting position on the second object.

9. A method as in claim 8, including steps of moving the base upon which the user is positioned in said first leaning or standing position in a translational direction to said second leaning or standing position, wherein said second leaning or standing position is further away than a reach of rotation of the base.

10. A method as in claim 9, including steps of receiving the user onto the base from the first object.

11. A method as in claim 9, including steps of depositing the user from the base onto the second object.

12. A method as in claim 8, including steps of rotating the base upon which the user is positioned in the first leaning or standing position to reach the second leaning or standing position, wherein the user is repositioned from the first object to the second object.

13. A method as in claim 8, including steps of positioning the user in a harness; coupling the harness to the lifting/lowering mechanism; whereby one or more of moving the lifting/lowering mechanism in a first direction lifts the user, moving the lifting/lowering mechanism in a second direction lowers the user.

14. A method as in claim 8, including steps of stabilizing the user while in the first and second leaning or standing positions, using one or more stabilizer bars.

15. A method as in claim 8, wherein one or more of: the first object, the second object, includes a chair.

16. A method as in claim 8, wherein the lifting/lowering mechanism includes a motor.

17. A method as in claim 8, including steps of translationally moving the user and the lifting/lowering mechanism together by motorized translation, from the first leaning or standing position to the second leaning or standing position, near the second object.

* * * * *